US006785485B2

(12) United States Patent
Kamimura

(10) Patent No.: US 6,785,485 B2
(45) Date of Patent: Aug. 31, 2004

(54) IMAGE FORMING DEVICE WITH FILMING CLEANING FUNCTION

(75) Inventor: Naoya Kamimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 21 days.

(21) Appl. No.: 10/050,828

(22) Filed: Jan. 18, 2002

(65) Prior Publication Data

US 2002/0098013 A1 Jul. 25, 2002

(30) Foreign Application Priority Data

Jan. 19, 2001 (JP) ..... 2001-012107

(51) Int. Cl.[7] ..... G03G 15/00
(52) U.S. Cl. ..... 399/71; 399/347
(58) Field of Search ..... 399/71, 343, 347, 399/357, 149, 150, 167, 53

(56) References Cited

U.S. PATENT DOCUMENTS

| | | | | |
|---|---|---|---|---|
| 5,287,150 A | | 2/1994 | Kinoshita et al. | |
| 5,667,926 A | * | 9/1997 | Maruyama et al. | 430/97 |
| 5,832,342 A | * | 11/1998 | Hazama et al. | 399/107 |
| 6,041,203 A | | 3/2000 | Suzuki et al. | |
| 6,101,350 A | | 8/2000 | Suzuki et al. | |

FOREIGN PATENT DOCUMENTS

| | | | | |
|---|---|---|---|---|
| JP | 57030872 A | * | 2/1982 | G03G/21/00 |
| JP | 01136168 A | * | 5/1989 | G03G/15/00 |
| JP | 04043378 A | * | 2/1992 | G03G/15/08 |
| JP | 05100559 A | * | 4/1993 | G03G/15/08 |
| JP | 09258527 A | * | 10/1997 | G03G/15/02 |
| JP | 09258548 A | * | 10/1997 | G03G/15/08 |
| JP | 10020663 A | * | 1/1998 | G03G/15/08 |
| JP | 2000162937 A | * | 6/2000 | G03G/21/10 |
| JP | A 2000-250378 | | 9/2000 | |

* cited by examiner

*Primary Examiner*—Robert Beatty
(74) *Attorney, Agent, or Firm*—Oliff & Berridge, PLC

(57) ABSTRACT

An image forming device develops a static-electric latent image into a visible image using non-magnetic, single component developer. The image forming device includes a photosensitive drum and a developing roller that are disposed in confrontation with each other. The photosensitive drum supports a static-electric latent image on its surface and the developing roller supplies the non-magnetic, single component developer to develop the static-electric latent image into a visible image. The image forming device further includes a photosensitive drum driver and a developing roller driver for driving rotation of the photosensitive drum and the developing roller, respectively. A drive controller is provided for controlling drive of the photosensitive drum driver and the developing roller driver. During at least a portion of a non-image forming period when no images are being formed in an image formation process, the drive controller controls the developing roller driver to stop driving the developing roller to rotate while controlling the photosensitive drum driver to drive the photosensitive drum to rotate.

33 Claims, 7 Drawing Sheets

IMAGE FORMING DEVICE WITH FILMING CLEANING FUNCTION

BACKGROUND OF THE INVENTION

1. Field of the Invention

The present invention relates to an image forming device such as a laser printer.

2. Description of the Related Art

Laser printers and other image forming devices have been known that use a non-magnetic, single-component toner as an image developer. Such an image forming device includes a photosensitive drum and various components located around the photosensitive drum. The various components include a charge unit, a scanner unit, a developing roller, and a transfer roller disposed in this order around the photosensitive drum following the rotational direction of the photosensitive drum. The photosensitive drum is rotated so that the surface of the photosensitive drum moves to the charge unit, where it is uniformly charged, then to the scanner unit, where it is exposed by a high speed scanned laser beam to form a static-electric latent image on the surface of the photosensitive drum based on image data.

On the other hand, a thin layer of non-magnetic, single-component toner is borne on the developing roller. When rotation of the photosensitive drum brings the toner borne on the developing roller into confrontation with the static-electric latent image formed on the surface of the photosensitive drum, the toner is selectively borne on the static-electric latent image, thereby developing the static-electric latent image into a visible toner image. Then further rotation of the photosensitive drum brings the visible toner image borne on the surface of the photosensitive drum into confrontation with the transfer roller. The visible toner image is transferred to a sheet passing between the photosensitive drum and the transfer roller.

After the visible toner image is transferred to the sheet, paper dust (particularly filler), toner (particularly external additive), and the like that remains on the photosensitive drum can sometimes cling to the surface of the photosensitive drum. This is referred to as "filming." Filming can reduce the quality of images and also reduce the life of the photosensitive drum.

Impression development devices are particularly susceptible to filming problems. Impression development devices are image forming devices that use non-magnetic, single-component toner and that develop the static-electric latent image by contact between the photosensitive drum and the developing roller. However, because images are developed by scraping the toner borne on the developing roller against the photosensitive drum, abrasion from the toner can greatly damage the surface of the photosensitive drum and filming is particularly likely to occur.

One known method for removing filming from the photosensitive drum is to provide a separate roller made from a resilient member for scraping against the photosensitive drum to remove filming. However, providing a separate roller in this manner increases the size and production expense of the image forming device.

U.S. Pat. No. 5,287,150 describes setting the peripheral speed of a photosensitive drum to 50 mm/sec and the peripheral speed of the developing roller to 70 mm/sec. Because the developing roller rotates faster than the photosensitive drum, the developing roller polishes the filming from the surface of the photosensitive drum.

SUMMARY OF THE INVENTION

It is conceivable that the peripheral speed of the developing roller can be changed during periods other than image forming periods, so that during these periods a difference in peripheral speed is generated between the developing roller and the photosensitive drum, and consequently the developing roller polishes the surface of the photosensitive drum. However, in a non-magnetic, single-component developing method, the developing roller is driven to rotate to form an optimum toner layer during image forming periods. If the rotational speed of the developing roller is changed, formation of the toner layer on the developing roller will be unstable, that is, formed with a different thickness than normal For example, if the rotational speed of the developing roller is increased, then the toner layer will be thinner than normal. Similarly, if the rotational speed of the developing roller is decreased, then the toner layer will be thicker than normal. Also, the amount of toner that the developing roller supplies to the photosensitive drum also changes with the peripheral speed of the developing roller. Because the developing mechanism is designed assuming that the developing roller will rotate at a particular speed, if the rotational speed is changed, then the ratio of improperly charged toner will increase.

Although toner is not uniformly charged when it is first supplied to the developing roller, the toner on the developing roller is charge to the same polarity by friction charging by the thickness regulating blade. If the thickness of the toner layer on the developing roller changes, then the ratio of improperly charged toner, such as toner that is charged to the opposite charge than that required for image formation, can increase. This oppositely charged toner can undesirably cling to the photosensitive drum and cause poor quality image formation.

It is an objective of the present invention to overcome the above-described problems and provide a non-magnetic, single-component type image forming device with a simple configuration capable of removing filming from the photosensitive drum so that good-quality images can be formed.

To achieve the above-described objectives, an image forming device according to the present invention includes a photosensitive drum and a developing roller disposed in confrontation and in contact with each other. The photosensitive drum is adapted for supporting a static-electric latent image on its surface and the developing roller is adapted to bear developer. The image forming device further includes a photosensitive drum driver and a developing roller driver for driving rotation of the photosensitive drum and the developing roller, respectively. A drive controller is provided that controls the developing roller driver to one of stop driving the developing roller and maintain the developing roller in a non-rotating condition, while controlling the photosensitive drum driver to drive the photosensitive drum to rotate.

With this configuration, the surface of the rotating photosensitive drum rubs against the developing roller while the developing roller is stopped. This polishes off any filming from the surface of the photosensitive drum, without the need to provide a separate cleaning member for cleaning the surface of the photosensitive drum. As a result, filming can be properly removed and the image forming device can be made more compact and less expensively.

Further, because the developing roller is stopped, and not merely sped up or slowed down, no unstable toner layer will be formed on the developing roller while the developing roller is stopped. An optimum toner layer can always be formed on the developing roller, so that good images can be formed using a non-magnetic, single component developing method.

A method according to the present invention is for removing film from the surface of a photosensitive drum that is in contact with a developing roller. The method includes starting rotation of the photosensitive drum while the developing roller is maintained in an unmoving condition so that surface of the photosensitive drum rubs against the developing roller; and subsequently starting rotation of the developing roller.

A method according to another aspect of the present invention includes starting rotation of the photosensitive drum and the developing roller substantially simultaneously; and subsequently stopping rotation of the developing roller to bring the developing roller into an unmoving condition while maintaining the photosensitive drum in a rotating condition so that surface of the photosensitive drum rubs against the developing roller.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENTS

Figure 1:
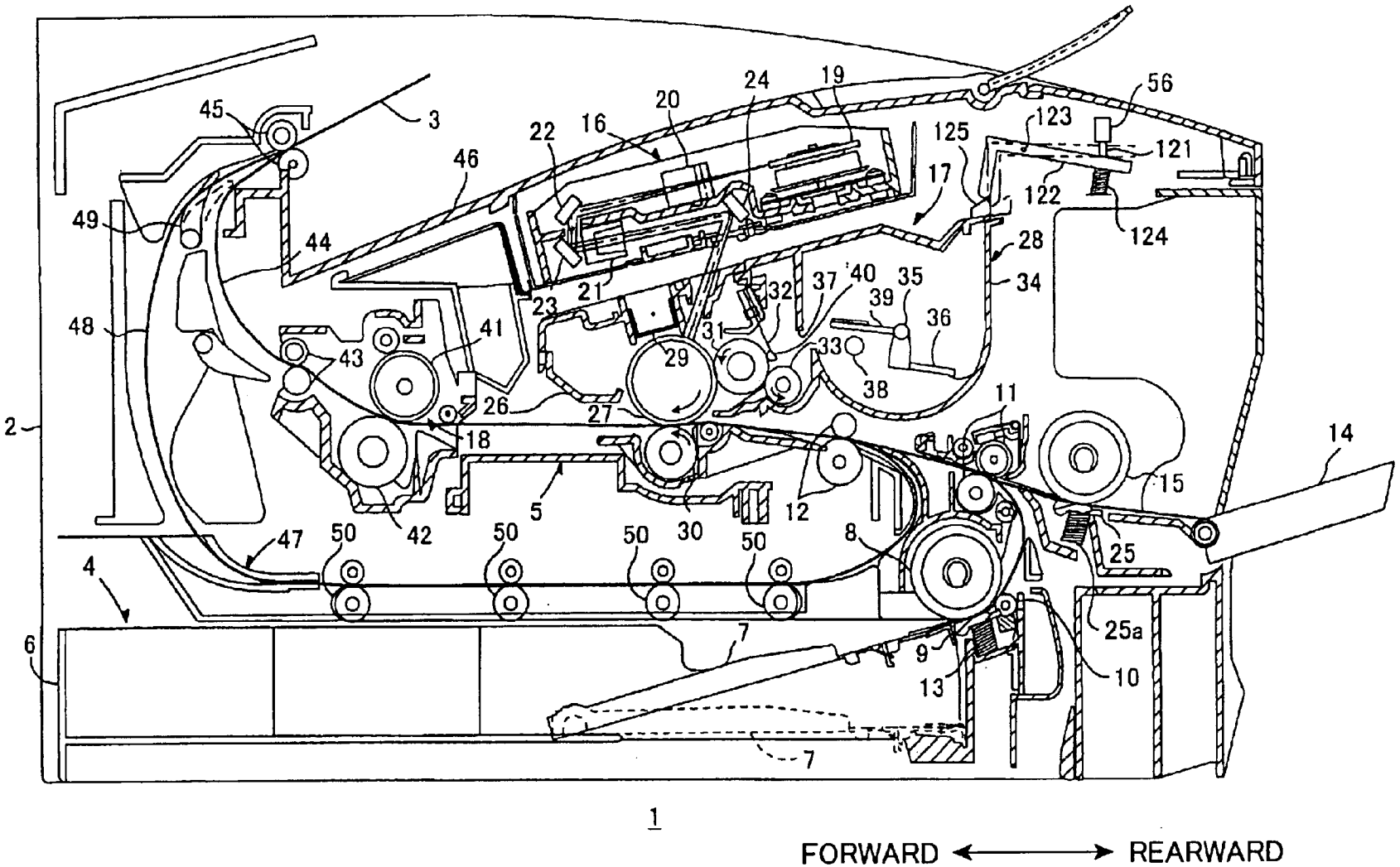
FIG. 1 is a cross-sectional view showing essential portions of a laser printer according to a first embodiment of the present invention.

Next, an image forming device according to a first embodiment of the present invention will be described. The image forming device of the embodiment is a monochrome laser printer 1. As shown in FIG. 1, the laser printer 1 includes a casing 2 and various components, such as a feeder 4 and an image forming unit 5, housed in the casing 2. The feeder 4 is for supplying sheets 3 to the image forming unit 5. The image forming unit 5 forms images on the supplied sheets 3.

The feeder 4 includes a sheet-supply tray 6 a sheet-pressing plate 7, a sheet-feed roller 8, a sheet-feed pad 9, paper-dust removal rollers 10, 11, and registration rollers 12. The sheet-supply tray 6 is detachably mounted in the lower portion in the casing 2. The sheet-pressing plate 7 is provided within the sheet-supply tray 6. The sheet-feed roller 8 and the sheet-feed pad 9 are disposed above one end of the sheet-supply tray 6. The paper-dust removal rollers 10, 11 are disposed downstream from the sheet-feed roller 8 with respect to the direction in which sheets 3 are transported. The registration rollers 12 are provided downstream from the paper-dust removal rollers 10, 11 with respect to the transport direction of the sheets 3.

The sheet-pressing plate 7 is adapted for supporting a stack of sheets 3. The sheet-pressing plate 7 is supported pivotable at the end of the sheet-pressing plate 7 that is furthest from the sheet-feed roller 8, so that the end nearest the sheet-feed roller 8 can move vertically up and down. Although not shown in the drawings, a spring is provided beneath the sheet-pressing plate 7 for urging the sheet-pressing plate 7 upward. When the amount of sheets 3 stacked on the sheet-pressing plate 7 is increased, the sheet-pressing plate 7 pivots downward against the urging force of the spring, with the end furthest from the sheet-feed roller 8 serving as a fulcrum. The sheet-feed roller 8 and the sheet-feed pad 9 are disposed in confrontation with each other. A spring 13 disposed to the underside of the sheet-feed pad 9 presses the sheet-feed pad 9 toward the sheet-feed roller 8. The sheet 3 that is uppermost on the stack on the sheet-pressing plate 7 is pressed toward the sheet-feed roller 8 by the spring (not shown) under the sheet-pressing plate 7. After rotation of the sheet-feed roller 8 sandwiches a sheet 3 between the sheet-feed roller 8 and the sheet-feed pad 9, one sheet is feed out from the sheet-supply tray 6 at a time. The sheet 3 is transported to the registration rollers 12 after the paper-dust removal rollers 10, 11 remove paper dust from the fed sheet 3. The registration rollers 12 include a pair of rollers. After the registration rollers 12 perform a predetermined registration operation on the sheet 3, the sheet 3 is transported to the image forming unit 5.

The feeder 4 further includes a multi-purpose tray 14, a multi-purpose-side sheet-feed roller 15, and a multi-purpose-side sheet-feed pad 25. The multi-purpose-side sheet-feed roller 15 is for feeding sheets 3 stacked on the multi-purpose tray 14. The multi-purpose-side sheet-feed roller 15 and the multi-purpose-side sheet-feed pad 25 are disposed in confrontation with each other. A spring 25*a* is disposed to the underside of the multi-purpose-side sheet-feed pad 25. The spring 25*a* presses the multi-purpose-side sheet-feed pad 25 toward the multi-purpose-side sheet-feed roller 15. Rotation of the multi-purpose-side sheet-feed roller 15 sandwiches a sheet from the stack on the multi-purpose tray 14 and then feeds out one sheet at a time from the multi-purpose tray 14.

The image forming unit 5 includes a scanner unit 16, a process unit 17, and a fixing unit 18.

The scanner unit 16 is disposed in the top portion of the casing 2 and includes a laser emitting portion (not shown), a polygonal mirror 19, lenses 20, 21, and reflection mirrors 22, 23, 24. The polygonal mirror 19 is driven to rotate. The laser emitting portion emits a laser beam based on image data. As indicated by the dot chain line in FIG. 1, the laser beam is reflected off or passes through the polygon mirror 19, the lens 20, the reflection mirrors 22 and 23, the lens 21, and the reflection mirror 24 in this order so as to be scanned at a high speed on the surface of a photosensitive drum 27 of the process unit 17 to be described later.

Figure 2:
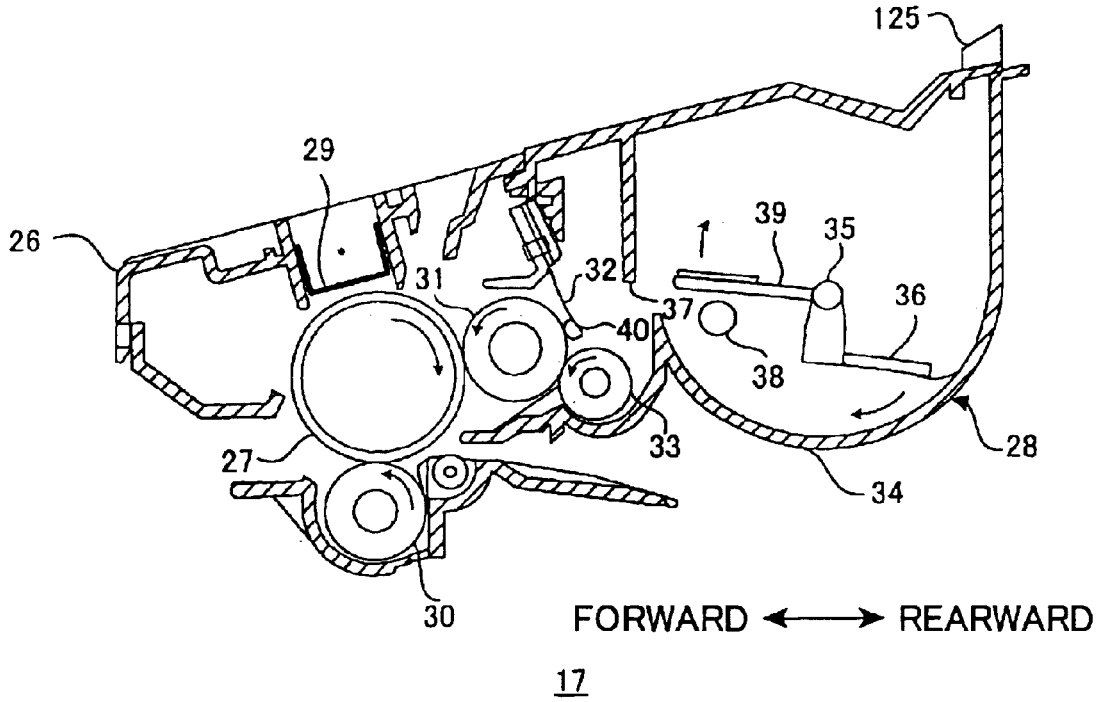
FIG. 2 is a cross-sectional view showing a process unit of the laser printer of FIG. 1, wherein a developing roller and a photosensitive drum are in contact with each other.

The process unit 17 is disposed below the scanner unit 16 and includes a drum cartridge 26, the photosensitive drum 27, a developing cartridge 28, a scorotron charge unit 29, and a transfer roller 30. The drum cartridge 26 is freely detachably mounted in the casing 2. As shown in FIG. 2, the photosensitive drum 27, the developing cartridge 28, the scorotron charge unit 29, and the transfer roller 30 are provided in the drum cartridge 26.

The developing cartridge 28 is freely detachably mounted in the drum cartridge 26 and includes a developing roller 31, a layer-thickness regulating blade 32, a supply roller 33, and a toner holding portion 34. The developing cartridge 28 is slidable forward and rearward, that is, away from and toward the drum cartridge 26 under the drive of a separating solenoid 56 shown in FIG. 4.

A positively-charging, non-magnetic, single-component toner fills the toner holding portion 34. A polymer toner is used in the embodiment. The polymer toner can be made by copolymerizing a polymerizing monomer using a well-known polymerization method such as suspension polymerization. Examples of polymerizing monomers include styrene monomers such as styrene and acrylic monomers such as acrylic acid alkyl (C1–C4) acrylate, and alkyl (C1–C4) meta-acrylate. Particles of the polymerized toner are spherical and so have extremely good fluidity so that high-quality images can be formed. Wax and a coloring agent, such as carbon black, are added to the toner. Also, an external additive such as silica is added to the toner for the purpose of increasing fluidity of the toner. The particles of the toner have a particle diameter of about 6 to 10 micrometers. The toner is adjusted to have a charge-to-mass ratio Q/M having an absolute value of 10 micro coulombs/gram or greater.

An agitator 36 is supported on a rotation shaft 35 provided in the center of the toner holding portion 34. Rotation of the agitator 36 in the counterclockwise direction of FIG. 1 agitates the toner in the toner holding portion 34 and discharges the toner from a toner supply opening 37 opened in the side surface of the toner holding portion 34. It should be noted that a window 38 is provided in the side wall of the toner holding portion 34 for detecting the remaining amount of toner in the toner holding portion 34. A cleaner 39 supported on the rotation shaft 35 cleans the window 38.

The supply roller 33 is disposed to the side of the toner supply opening 37, rotatable in the counterclockwise direction as indicated by an arrow in FIG. 1 The developing roller 31 is disposed in confrontation with the supply roller 33, also rotatable in the counterclockwise direction as indicated by an arrow in FIG. 1. The supply roller 33 and the developing roller 31 abut against each other so that both are compressed by a certain amount.

The supply roller 33 is formed from a metal roller shaft covered by a conductive sponge roller.

The developing roller 31 is formed from a metal roller shaft converted by a resilient member, which is made from a conductive rubber material. More specifically, the roller of the developing roller 31 has a two-layer configuration including a roller portion and a surface coat layer. The roller portion is formed from a conductive resilient material such as EPDM rubber, silicon rubber, urethane rubber incorporated with, for example, carbon particles. The surface coat layer covers the surface of the roller portion. The surface coat layer has a greater hardness than the roller portion. Examples of the main component of the surface coat layer include urethane rubber, urethane resin, and polyimide resin.

Figure 4:
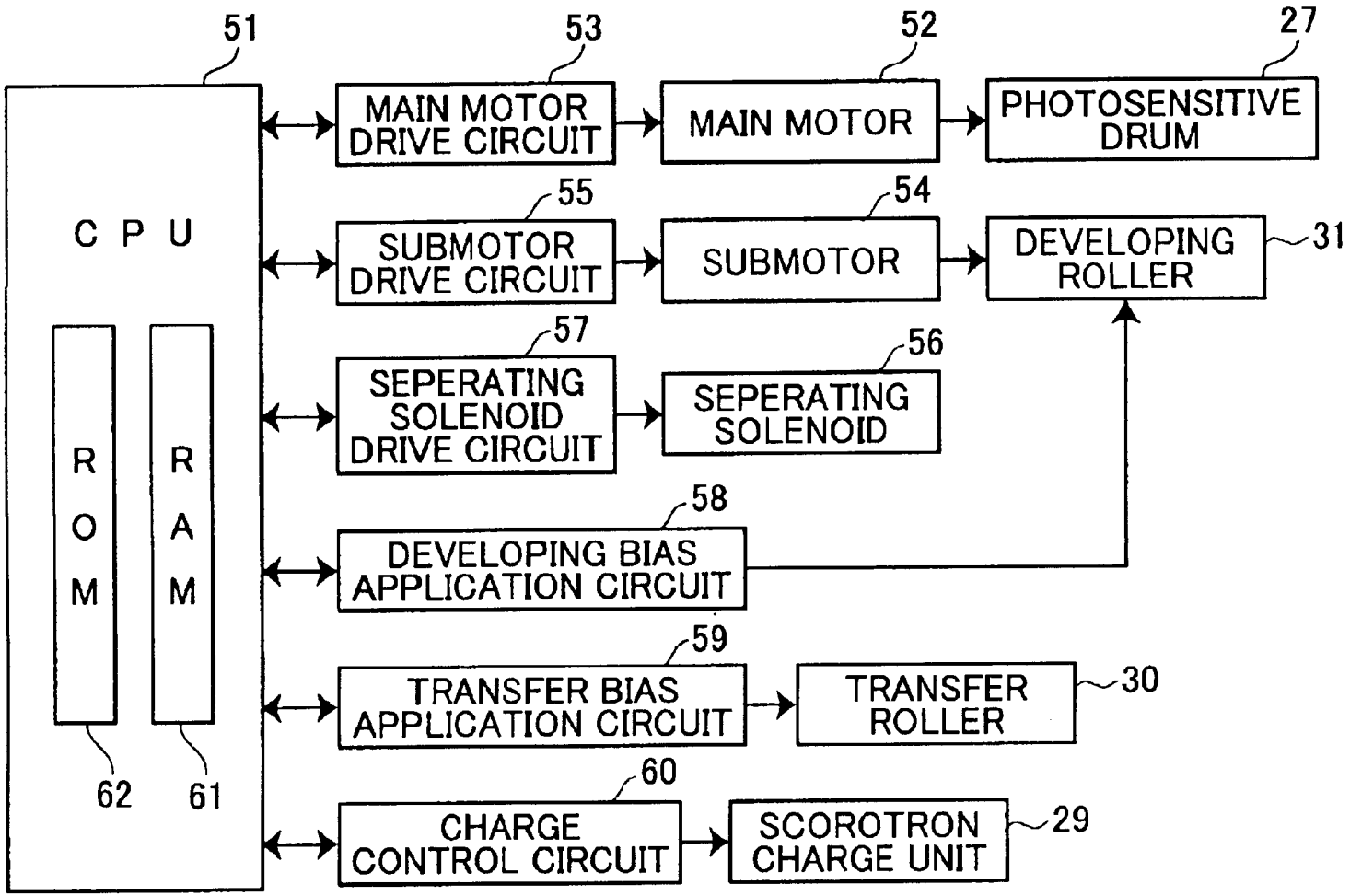
FIG. 4 is a block diagram showing electrical components of a control system of the laser printer of FIG. 1.

A submotor shown in FIG. 4 is provided for driving the developing roller 31. A developing bias application circuit 58 shown in FIG. 4 applies a predetermined developing bias to the developing roller 31.

The layer-thickness regulating blade 32 is disposed near the developing roller 31. The layer-thickness regulating blade 32 includes a metal plate spring and a pressing portion 40 attached to the free end of the plate spring. The pressing portion 40 is formed from silicon rubber, which has electrical insulation properties. The pressing portion 40 has a half circle shape in cross section. The layer-thickness regulating blade 32 is supported on the developing cartridge 28 at a position near the developing roller 31 so that the pressing portion 40 is pressed against the developing roller 31 by resiliency of the plate spring.

Rotation of the supply roller 33 supplies the toner from the toner supply opening 37 to the developing roller 31. The toner is charged to a positive charge by friction between the supply roller 33 and the developing roller 31. The toner supplied onto the developing roller 31 enters between the developing roller 31 and the pressing portion 40 of the layer-thickness regulating blade 32 in association with rotation of the developing roller 31. The toner is sufficiently charged by friction between the pressing portion 40 and the developing roller 31 and regulated to a thin layer with a uniform thickness on the developing roller 31.

The photosensitive drum 27 is disposed to the side of the developing roller 31 and is rotatable in contact with the developing roller 31 in the clockwise direction as indicated by an arrow in FIG. 1. The drum body of the photosensitive drum 27 is grounded. The surface of the photosensitive drum 27 is formed from a photosensitive layer of a dispersion-type, single layer, organic photosensitive body. A charge generating material is dispersed in the charge transporting layer. Also, the main motor 52 shown in FIG. 4 drives rotation of the photosensitive drum 27.

The scorotron charge unit 29 is disposed above the photosensitive drum 27, separated by a predetermined distance from the photosensitive drum 27 so as not to contact the photosensitive drum 27. The scorotron charge unit 29 is a scorotron charge unit that, in order to positively charge the surface of the photosensitive drum 27, generates a corona discharge from a charge wire made from tungsten, for example. The scorotron charge unit 29 charges the surface of the photosensitive drum 27 to a uniform positive charge. The scorotron charge unit 29 is controlled to charge by a charge control circuit 60 shown in FIG. 4.

As the photosensitive drum 27 rotates, the surface of the photosensitive drum 27 is first charged uniformly to a positive charge by the scorotron charge unit 29, and then exposed by the high-speed scanning laser beam from the scanner unit 16 to form a static-electric latent image based on image data.

As the developing roller 31 confronts and contacts the photosensitive drum 27, rotation of the developing roller 31 supplies positively-charged toner that is borne on the developing roller 31 to the static-electric latent image formed on the surface of the photosensitive drum 27. At this time, the toner is selectively borne on only portions of the photosensitive drum 27 that were exposed by the laser beam. That is, when the laser beam exposes portions of the uniformly positively charged surface of the photosensitive drum 27, the electric potential drops at the exposed portions. The supplied toner is selectively transferred to only the exposed portions, thereby developing the static-electric latent image into a visible toner image. In this way, an inverse development operation is performed.

The transfer roller 30 is disposed below the photosensitive drum 27 in confrontation with the photosensitive drum 27, and supported so as to be rotatable in the counterclockwise direction as indicated by an arrow in FIG. 1. The transfer roller 30 is made from a metal roller shaft covered by a roller made from a conductive rubber material. The transfer roller 27 rotates following drive of the photosensitive drum 27. A transfer bias application circuit 59 shown in FIG. 4 applies a transfer bias to the transfer roller 27 with respect to the photosensitive drum 27, when the visible toner image is to be transferred from the photosensitive drum 27. As a result, the visible toner image borne on the surface of the photosensitive drum 27 is transferred to sheets 3 while sheets 3 pass between the photosensitive drum 27 and the transfer roller 30.

As shown in FIG. 1, the fixing unit 18 is disposed downstream from the process unit 17 and includes a thermal roller 41, a pressing roller 42, and a pair of transport rollers 43. The pressing roller 42 presses against the thermal roller 41. The pair of transport rollers 43 are provided downstream from the thermal roller 41 and the pressing roller 42. The thermal roller 41 is made from metal and is provided with a halogen lamp for heating up the metal. Sheets 3 are transported between the thermal roller 41 and the pressing roller 42 to thermally fix toner that was transferred onto the sheets 3 in the process unit 17 onto the sheets 3. Afterward, the transport rollers 43 transport the sheets 3 to a sheet-discharge path 44. Sheets 3 transported to the sheet-discharge path 44 are discharged by discharge rollers 45 onto a sheet-discharge tray 46.

The laser printer 1 is provided with an inverted transport portion 47 for enabling formation of images on both surface of the sheets 3. The inverted transport portion 47 includes the sheet-discharge rollers 45, an inverted transport path 48, a flapper 49, and a plurality of inverted transport rollers 50.

The sheet-discharge rollers 45 include a pair of rollers that can be switchingly driven to rotate in forward and reverse directions. That is, the sheet-discharge rollers 45 are driven to rotate forward when a sheet 3 is to be discharged onto the sheet-discharge tray 46 and to rotate in reverse when a sheet 3 is to be inverted.

The inverted transport path 48 is provided following the vertical direction so as to enable sheets 3 to be transported from the sheet-discharge roller 45 to the plurality of inverted transport rollers 50, which are disposed below the image forming unit 5. The inverted transport path 48 is oriented with its upstream end adjacent to the sheet-discharge roller 45 and its downstream end adjacent to the inverted transport rollers 50.

The flapper 49 is swingably disposed at the junction of the sheet-discharge path 44 and the inverted transport path 48. Although not shown in the drawings, a switch solenoid is provided that, by being selectively energized and not energized, switches the flapper 49 back and forth to select transport direction of sheets 3 that have been inverted by the sheet-discharge rollers 45 from the direction of the sheet-discharge path 44 to the direction of the inverted transport path 48.

The inverted transport rollers 50 are provided in pair sets aligned horizontally above the sheet-supply tray 6. The pair of inverted transport rollers 50 that are located furthest upstream are disposed adjacent to the rear end of the inverted transport path 48. The pair of inverted transport rollers 50 that are located furthest downstream are disposed below the registration rollers 12.

The inverted transport portion 47 operates in the following manner when images are to be formed on both sides of a sheet 3. After an image is formed on one side of a sheet 3, the transport rollers 43 transport the sheet 3 from the sheet-discharge path 44 to the sheet-discharge rollers 45. The sheet-discharge rollers 45 rotate forward with the sheet 3 sandwiched therebetween to transport the sheet 3 toward the outside of the printer 1, that is, toward the sheet-discharge tray 46. After most of the sheet 3 is transported out of the printer 1, the sheet-discharge rollers 45 stop rotating while the end edge of the sheet 3 remains sandwiched therebetween, The sheet-discharge rollers 45 are then rotated in reverse and the flapper 49 switches transport direction so that the sheet 3 is transported into the inverted transport path 48 with front and rear surfaces of the sheet 3 reversed. Once transport of the sheet 3 is complete, the flapper 49 switches back to the position for transporting sheets 3 to the sheet-discharge rollers 45. The sheet 3 transported backward into the inverted transport path 48 is transported by the inverted transport rollers 50 to the registration rollers 12 with upper and lower sides reversed. The registration rollers 12 perform a registration operation on the sheet 3 with the sheet upside down. Then, the sheet 3 is transported toward the image forming unit 5, which forms an image on the other side of the sheet 3.

The laser printer 1 uses the developing roller 31 to collect residual toner that remains on the surface of the photosensitive drum 27 after the transfer roller 30 transfers the visible toner image onto the sheet 3. This is referred to as the "cleanerless method" for collecting residual toner. By using the cleanerless method to collect residual toner from the surface of the photosensitive drum 27, there is no need to provide the laser printer 1 with a cleaner unit, such as a scraping blade, or a unit for holding the waste toner. Therefore, the configuration of the printer is simpler, and the printer can be made smaller and less expensively.

FIG. 4 is a block diagram showing a portion of a drive system of the laser printer 1. As shown in FIG. 4, a central control unit (CPU) 51 is connected to various components, including a main motor drive circuit 53, a submotor drive circuit 55, a separating solenoid drive circuit 57, a developing bias application circuit 58, a transfer bias application circuit 59, and a charge control circuit 60. The main motor drive circuit 53 is for controlling the main motor 52 to drive the photosensitive drum 27. The submotor drive circuit 55 is for controlling the submotor 54 to drive the developing roller 31. The separating solenoid drive circuit 57 is for controlling drive of the separating solenoid 56.

The CPU 51 includes a RAM 61 and a ROM 62 and controls the various components of the drive system. The RAM 61 temporarily stores values used for controlling drive of the various components. The ROM 62 stores drive control programs for controlling the main motor drive circuit 53, the submotor drive circuit 55, the separating solenoid drive circuit 57, the developing bias application circuit 58, and the transfer bias application circuit 59.

The main motor 52 is connected to the main motor drive circuit 53. Although not shown in the drawings, a gear train is provided that link the main motor 52 to various sheet-transporting components, such as the paper-dust removal rollers 10, 11, the registration rollers 12, the pressing roller 42, and the transport roller 43, and a gear train is provided for connecting the main motor 52 to the photosensitive drum 27. The CPU 51 executes the drive control programs stored in the ROM 62 to control, via the main motor drive circuit 53, the main motor 52 to selectively drive and stop drive. As a result, as the main motor 52 is controlled to drive and stop drive in accordance with the drive control programs, the photosensitive drum 27 is controlled to rotate or stop rotating.

The submotor 54 is connected to the submotor drive circuit 55. Although not shown in the drawings, a gear train is provided that links the submotor 54 to the developing roller 31. The CPU 51 executes the drive control programs stored in the ROM 62 to control, via the submotor drive circuit 55, the submotor 54 to selectively drive and stop drive. As a result, as the submotor 54 is controlled to drive and stop drive in accordance with the drive control programs, the developing roller 31 is controlled to rotate or stop rotating.

It should be noted that when the submotor 54 is controlled to stop driving rotation of the developing roller 31, not only is the submotor 54 energized to stop driving, but also resistance caused by meshing engagement between gears of the gear trains (not shown) blocks any further rotation of the developing roller 31. As a result, the developing roller 31 is reliably prevented from rotating even while the photosensitive drum 27 is being driven to rotate while in contact with the developing roller 31. With this configuration, when the photosensitive drum 27 is driven to rotate while rotation of the developing roller 31 is stopped, the photosensitive drum 27 rubs against the surface of the developing roller 31 while the developing roller 31 is completely immobile, so that any filming on the surface of the photosensitive drum 27 can be polished off.

It should be noted that rotation of the developing roller 31 need not be regulated by resistance cause by meshing engagement of gears, but a separate locking mechanism can be provided to the developing roller 31 for regulating rotation of the developing roller 31.

Figure 3:
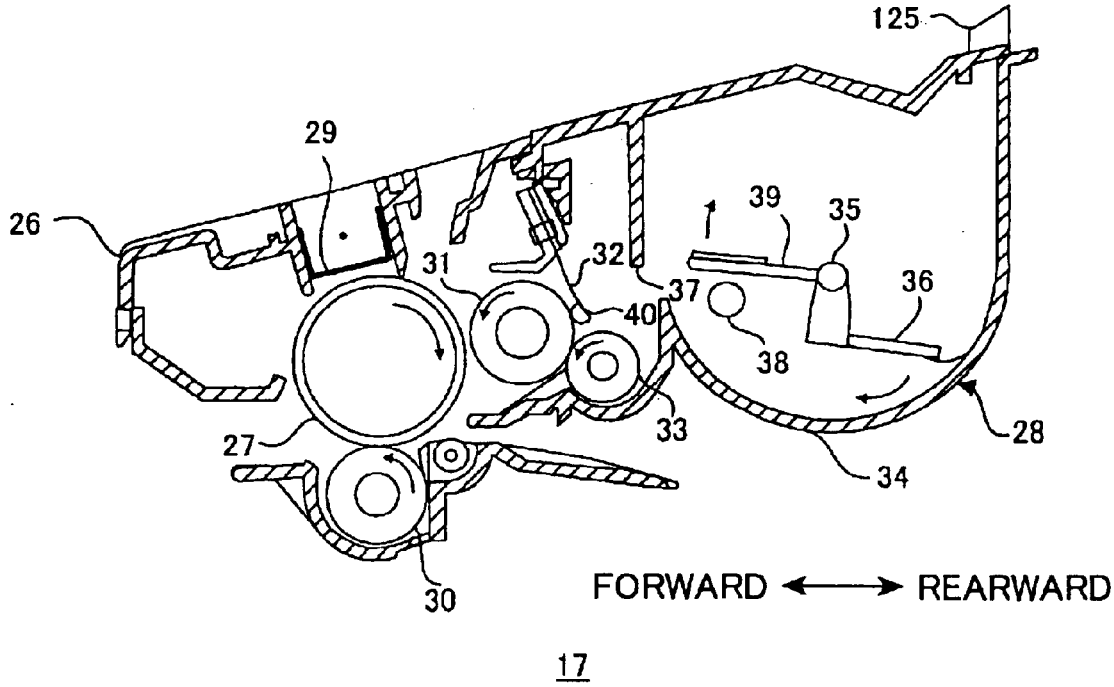
FIG. 3 is a cross-sectional view showing the process unit of FIG. 2, wherein the developing roller and the photosensitive drum are separated from each other.

The separating solenoid 56 is connected to the separating solenoid drive circuit 57. The separating solenoid 56 is provided for sliding the developing cartridge 28 forward and rearward, that is, toward and away from, the drum cartridge 26. When the separating solenoid 56 is energized, then as shown in FIG. 2 the developing cartridge 28 is moved to a forward position, that is, a contact position, with respect to the drum cartridge 26 so that the developing roller 31 and the photosensitive drum 27 are in contact with each other. When the separating solenoid 56 is not energized, then as shown in FIG. 3 the developing cartridge 28 is moved to a rearward position, that is, a separated position, with respect to the drum cartridge 26 so that the developing roller 31 and the photosensitive drum 27 are separated from each other by a small gap.

As shown in FIG. 1, the separating solenoid 56 is provided above the rear portion of the developing cartridge 28 in the casing 2, along with an L-shaped member 122 and a spring 124. The separating solenoid 56 is disposed so that its plunger shaft 121 extends downward when the separating solenoid 56 is energized and retracts when the separating solenoid 56 is not energized.

The L-shaped member 122 is supported freely pivotably about a fulcrum 123 positioned along the length of the long portion of the L-shaped member 122, with the long side oriented horizontally and the short side protruding downward when the separating solenoid 56 is not being energized. Further, the L-shaped member 122 is supported with the rear end of its longer section abutted by the extendable and retractable plunger shaft 121 of the separating solenoid 56 and with the free end of its shorter section constantly in contact with a slanting surface of a protrusion portion 125, which is formed integrally to the rear-upper surface of the developing cartridge 28. It should be noted that the slanting surface of the protrusion portion 125 is formed to slant upward from the forward end to the rearward end.

A spring 124 is disposed below the rear end of the longer section of the L-shaped member 122 at a position in vertical confrontation with the plunger shaft 121 of the separating solenoid 56 The spring 124 constantly urges the rear end portion of the longer section of the L-shaped member 122 upward.

As indicated by broken line in FIG. 1, while the separating solenoid 56 is not being energized, the plunger shaft 121 of the separating solenoid 56 is retracted by urging force of the spring 124 and the L-shaped member 122 pivots around the fulcrum 123 so that the free end of the shorter section moves downward to press against the slanting surface of the protruding portion 125. Because of the pressing force from the L-shaped member 122, the protrusion 124 of the developing cartridge 28 moves in the direction that avoids the pressing force. Therefore, the developing cartridge 28 moves to the separation position with respect to the drum cartridge 26. As a result, the developing roller 31 and the photosensitive drum 27 are separated by a small gap.

When the separating solenoid 56 is energized, then as indicated by solid line in FIG. 1, the plunger shaft 121 of the separating solenoid 56 extends downward. This presses the rear end of the longer section of the L-shaped member 122 downward against the urging force of the spring 124. As a result, the L-shaped member 122 pivots around the fulcrum 123 so that the free end of the shorter section of the L-shaped member 122 moves upward and separates from the slanting surface of the protruding portion 125.

Although not shown in the drawings, a spring is provided at the rear end of the developing cartridge 28 for urging the developing cartridge 28 toward the drum cartridge 26. Under the urging force of this spring, the developing cartridge 28 is moved into the contact position with respect to the drum cartridge 26 in accordance with movement of the shorter section of the L-shaped member L-shaped member 122, so that the developing roller 31 and the photosensitive drum 27 are brought into contact as shown in FIG. 2.

It should be noted that other separation mechanisms can be used to move the developing roller 31 and the photosensitive drum 27 into and out of contact. For example, one such mechanism is described in U.S. Pat. No. 6,041,203, the disclosure of which is hereby incorporated by reference.

The CPU 51 controls the separating solenoid drive circuit 57 to energize and stop energizing the separating solenoid 56 in accordance with the drive control programs stored in the ROM 62. As a result, the developing roller 31 and the photosensitive drum 27 are brought into and out of contact with each other by control of energizing and not energizing the separating solenoid 56 in accordance with the drive control programs.

The roller shaft of the developing roller 31 is connected to the developing bias application circuit 58. The developing bias application circuit 58 applies a developing bias to the developing roller 31 in accordance to an on/off control of the drive control programs stored in the ROM 62 of the CPU 51.

The roller shaft of the transfer roller 30 is connected to the transfer bias application circuit 59. The transfer bias application circuit 59 applies a transfer bias to the transfer roller 30 in accordance to an on/off control of the drive control programs stored in the ROM 62 of the CPU 51.

The scorotron charge unit 29 is connected to the charge control circuit 60. The charge control circuit 60 controls the scorotron charge unit 29 to turn on (and to develop a corona discharge) and off in accordance with the drive control programs stored in the ROM 62 of the CPU 51.

The laser printer 1 develops the static-electric latent image on the photosensitive drum 27 using impression developing, wherein the toner borne on the developing roller 31 is scraped onto the photosensitive drum 27. As a result, toner, particularly external additive, paper dust, and the like that remain on the surface photosensitive drum 27 after a visible toner image is transferred to a sheet 3, can easily cling to the surface of the photosensitive drum 27, resulting in filming. However, by executing the drive control program stored in the ROM 62, the CPU 51 controls to stop drive of the submotor 54, while executing drive of the main motor 52, during non-image forming periods when no images are being formed. As a result, the surface of driven photosensitive drum 27 rubs against the stopped developing roller 31, so that the filming is polished from the surface of the photosensitive drum 27.

Figure 5:
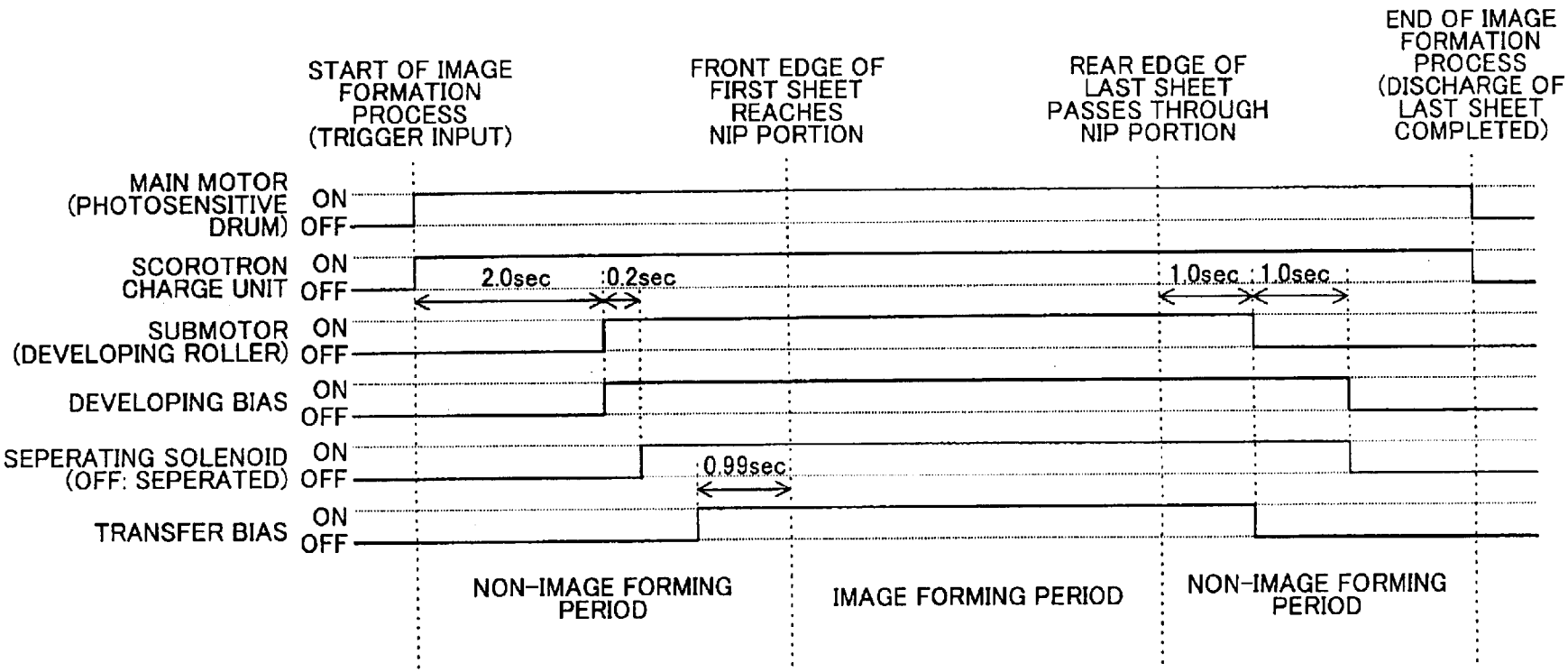
FIG. 5 is a timing chart showing drive timing of various components of the laser printer according to execution, of a drive control program in order to remove filming after an image forming period.

With this control, as shown in FIG. 5, directly after an image is formed on a sheet 3, that is, after the rear edge of the last sheet passes through the nip portion between photosensitive drum 27 and the transfer roller 30, the CPU 51 controls both the main motor 52 and the submotor 54 to drive the photosensitive drum 27 and the developing roller 31, respectively. At this time, the developing roller 31 and the photosensitive drum 27 are in contact with each other. From this condition, the CPU 51 first controls to stop the submotor 54 from driving rotation of the developing roller 31. Then, after the photosensitive drum 27 continues to rotate against the stopped developing roller 31 for at least a single rotation, the CPU 51 controls the separating solenoid drive circuit 57 to stop energizing the separating solenoid 56, so that the developing roller 31 and the photosensitive drum 27 separate from each other. Afterward, the CPU 51 then controls the main motor 52 to stop driving the photosensitive drum 27.

This control will be explained in more detail with reference to FIG. 5. Before an image formation process is started, all of the main motor 52, the scorotron charge unit 29, the submotor 54, developing bias, the separating solenoid 56, and the transfer bias are in an off or non-energized condition. At this time, the developing roller 31 and the photosensitive drum 27 are separated by a gap. When the CPU 51 receives a print job, it develops the print data from the print job into image data, such as bit map data. Afterward, a trigger indicating the start of an image formation process is input at a predetermined timing. Upon receiving input of the trigger, the CPU 51 turns on the main motor 52 to drive the photosensitive drum 27 and various components for transporting sheets 3 and turns on the scorotron charge unit 29 to charge the surface of the photosensitive drum 27 to a uniform positive charge. After a predetermined time of 2.0 seconds elapses, the CPU 51 controls to turn on the submotor 54 and the developing bias to drive rotation of the developing roller 31 and apply the developing bias to the driven developing roller 31. After a further 0.2 seconds elapse, the separating solenoid 56 is energized to bring the developing roller 31 and the photosensitive drum 27 into contact with each other while both are being driven to rotate. Then, the transfer bias is turned on 0.99 seconds before the front edge of the first sheet 3 reaches the nip portion between the photosensitive drum 27 and the transfer roller 30. As a result, the transfer bias is applied to the transfer roller 30 so that the visible toner image on the photosensitive drum 27 is transferred onto sheets 3 that pass between the photosensitive drum 27 and the transfer roller 30. It should be noted that the timing at which the transfer bias is turned on is set as a predetermined time from the time that a sheet detection sensor (not shown), which is provided downstream from the registration rollers 12, detects the front edge of the first sheet 3.

The on or energized condition of the main motor 52, the scorotron charge unit 29, the submotor 54, the developing bias, the separating solenoid 56, and the transfer bias is continued until visible toner images are transferred to a number of sheets 3 that need to be printed.

Then, the submotor 54 is turned off after 1.0 seconds elapse from when the end edge of the last sheet 3 passes through the nip portion where the photosensitive drum 27 and the transfer roller 30 contact each other. As a result, the developing roller 31 stops rotating. Simultaneously with this, the transfer bias is turned off so that the transfer bias is stopped being applied to the transfer roller 30. However, the developing bias is still applied to the stopped developing roller 31. It should be noted that timing at which the submotor 54 and the transfer bias are turned off is set as a predetermined time from the time that the sheet detection sensor (not shown), which is provided downstream from the registration rollers 12, detects the end edge of the last sheet 3.

Because of this, the submotor 54 is stopped while the main motor 52 is being driven, Therefore, the surface of the photosensitive drum 27 rubs against the stopped developing roller 31 so that filming is polished off from the surface of the photosensitive drum 27.

Then energization of the separating solenoid 56 is stopped after a predetermined time that is required for the photosensitive drum 27 to rotate once elapses. In this embedment, the predetermined time is 1.0 seconds As a result, the developing roller 31 is separated from the photosensitive drum 27 while the photosensitive drum 27 is still being driven to rotate. Also, the developing bias is turned off simultaneously with this. Once the last sheet 3 is discharged, the main motor 52 and the scorotron charge unit 29 are turned off, thereby completing an image formation process by stopping drive the photosensitive drum 27 and of various components for transporting sheets 3 and also stopping the scorotron charge unit 29 from charging the surface of the photosensitive drum 27. It should be noted that the discharge of the last sheet 3 is detected by a sheet-discharge sensor (not shown) and the main motor 52 and the scorotron charge unit 29 are turned off based on the detection by the sheet-discharge sensor.

This control method can be applied when the photosensitive drum 27 rotates with a peripheral speed of 93 mm/sec (16 ppm), the photosensitive drum 27 has a diameter of 100 mm $\phi$, and the developing roller 31 rotates with a peripheral speed of 158.1 mm/sec, which is 1.7 times the peripheral speed of the photosensitive drum 27.

This control can be achieved without providing any new special components so that the image forming device can be made in a compact size and less expensively. Also, by the simple control of stopping the submotor 54 and then the main motor 52 in this order after image formation is completed, the surface of the rotating photosensitive drum 27 can be rubbed against the stopped developing roller 31 so that filming can be properly removed from the surface of the photosensitive drum 27. Moreover, by controlling the developing roller 31 to stop without changing its rotational speed, the toner layer is stably formed on the surface of the developing roller 31 while the developing roller 31 is in the process of stopping. Accordingly, an optimal toner layer is always formed on the surface of the developing roller 31 so that proper image formation can be performed using the non-magnetic, single-component toner developing method.

The rotation of the photosensitive drum 27 not only transfers visible toner images onto sheets 3, but also contributes to transport of the sheets 3. Further, the main motor 52 drives a variety of components for transporting sheets 3, in addition to driving the photosensitive drum 27. Therefore, the main motor 52 must be driven after image formation is completed until transportation of the last sheet 3 is completed. However, if the main motor 52 is driven for too long of a time while the submotor 54 is stopped, both the developing roller 31 and the photosensitive drum 27 can be damaged by rubbing between the developing roller 31 and the photosensitive drum 27, thereby reducing their life.

However, because the separating solenoid 56 is controlled to separate the developing roller 31 and the photosensitive drum 27 at the timing described above, the submotor 54 can be stopped while the main motor 52 is still driven with the developing roller 31 and the photosensitive drum 27 separated and not in contact with each other. For this reason, by continuing drive of the main motor 52 after image formation is completed, the last sheet 3 can be properly transported while reducing damage by contact between the developing roller 31 and the photosensitive drum 27. This increases durability of the printer.

If after the submotor 54 is stopped, the developing roller 31 and the photosensitive drum 27 were separated before the photosensitive drum 27 rotates once completely, then different areas of the surface of the photosensitive drum 27 would be polished by different amounts, so that filming could not be properly removed. However, according to the present control, the developing roller 31 and the photosensitive drum 27 are separated after the photosensitive drum 27 rotates once completely after the submotor 54 is stopped. Therefore, filming can be properly removed without generating variation in the polishing amount.

Figure 6:
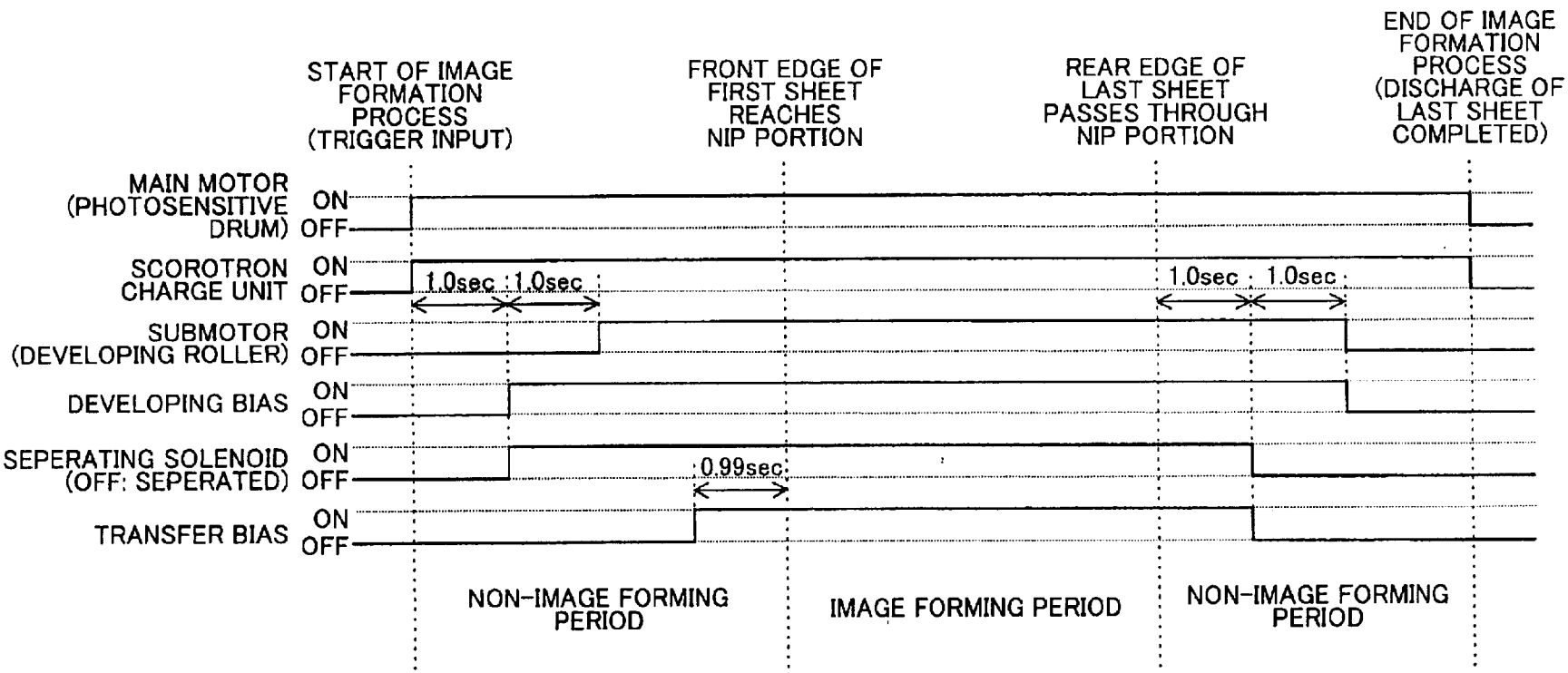
FIG. 6 is a timing chart showing drive timing of various components of the laser printer according to execution of a drive control program in order to remove filming before an image forming period.

FIG. 6 shows a modification of the control sequence represented in FIG. 5. In this modification, about 1.0 seconds after an image formation process is started, that is, after the trigger is input and the main motor 52 and the scorotron charge unit 29 are started, then the separating solenoid 56 is energized and also the developing bias is turned on. When the separating solenoid 56 is energized, the developing roller 31 and the photosensitive drum 27 are brought into contact with each other so that the photosensitive drum 27 rubs against the developing roller 31. This condition continues until the photosensitive drum 27 rotates once against the stopped developing roller 31, that is, for a further 1.0 seconds in the present modification. Then the submotor 54 is driven to rotate also.

This modification of the embodiment will be described in more detail. As shown in FIG. 6, before the image formation process begins, the main motor 52, the scorotron charge unit 29, the submotor 54, the developing bias, the separating solenoid 56, and the transfer bias are all in an off or non-energized condition. The developing roller 31 and the photosensitive drum 27 are in a separated condition. When the CPU 51 receives a print job, then the CPU 51 performs processes to develop the print data of the print job into image data, such as bit map data. At a predetermined timing after this, a trigger is input to indicate the start of an image formation process. The main motor 52 and the scorotron charge unit 29 are turned on when the trigger is input. As a result, the photosensitive drum 27 and various components for transporting the sheet 3 are driven, and also the surface of the photosensitive drum 27 is uniformly charged to a positive charge by the scorotron charge unit 29. After a predetermined duration of time, that is, 1.0 seconds in the present modification, the separating solenoid 56 is energized and the developing bias is turned on. As a result, the developing roller 31 and the photosensitive drum 27 are brought into contact with each other while the main motor 52 is driven and the submotor 54 is stopped, Therefore, the rotating photosensitive drum 27 rubs against the stopped developing roller 31 so that any filming on the surface of the photosensitive drum 27 is polished off. After a predetermined duration of time, the submotor 54 is turned on to drive rotation of the developing roller 31. The predetermined duration of time in this modification is 1.0 seconds, which is the time required for the photosensitive drum 27 to rotate once.

Next, the transfer bias is turned on 0.99 seconds before the front edge of the first sheet 3 reaches the nip portion where the photosensitive drum 27 and the transfer roller 30 contact each other. As a result, the transfer roller 30 is applied with a transfer bias so that visible images are transferred on the sheets 3 as they pass between the photosensitive drum 27 and the transfer roller 30. It should be noted that timing of when the transfer bias is turned on is set as a predetermined time from when the sheet detection sensor (not shown) provided downstream from the registration rollers 12 detects the front edge of the first sheet 3.

The on or energized condition of the main motor 52, the scorotron charge unit 29, the submotor 54, the developing bias, the separating solenoid 56, and the transfer bias continues until a visible toner image is transferred to the number of sheets 3 to be printed for the current print job. It should be noted that the on and energized conditions continue during the time between one sheet and the next.

Energization of the separating solenoid 56 and application of the transfer bias are stopped after 1.0 seconds elapses from when the end edge of the last sheet 3 passes between the nip portion where the photosensitive drum 27 and the transfer roller 30 contact each other. As a result, the developing roller 31 separates from the photosensitive drum 27 while the developing roller 31 and the photosensitive drum 27 are being driven to rotate, and also the transfer bias is no longer applied to the transfer roller 30. It should be noted that the timing for stopping energization of the separating solenoid 56 and for turning off the transfer bias is set as a predetermined timing from when the sheet detection sensor (not shown) provided downstream from the registration rollers 12 detects the rear edge of the last sheet 3.

Then, after a further 1.0 seconds elapses, the submotor 54 and the developing bias are turned off so that the developing roller 31 is stopped and the developing bias is no longer applied to the developing roller 31. The main motor 52 and the scorotron charge unit 29 are then turned off after the last sheet 3 is completely discharged. As a result, the photosensitive drum 27 and the various components for driving the transporting sheets 3 are stopped, and also charging of the surface of the photosensitive drum 27 is stopped, whereupon the image formation process is completed. It should be noted that the main motor 52 and the scorotron charge unit 29 are turned off based on when the sheet discharge sensor (not shown) detects that the last sheet 3 is discharged.

This control method can be applied when the photosensitive drum 27 rotates with a peripheral speed of 93 mm/sec (16 ppm), the photosensitive drum 27 has a diameter of 30 mm $\phi$, and the developing roller 31 rotates with a peripheral speed of 158.1 mm/sec, which is 1.7 times the peripheral speed of the photosensitive drum 27.

This control can be achieved without providing any new special components so that the image forming device can be made in a compact size and less expensively. Also, by the simple control of starting the main motor 52 and then the submotor 54 in this order before image formation is started, the surface of the rotating photosensitive drum 27 can be rubbed against the stopped developing roller 31 so that filming can be properly removed from the surface of the photosensitive drum 27. Moreover, by controlling the developing roller 31 to stop without changing its rotational speed, the toner layer is stably formed on the surface of the developing roller 31 while the developing roller 31 is in the process of stopping. Accordingly, an optimal toner layer is always formed on the surface of the developing roller 31 so that proper image formation can be performed using the non-magnetic, single-component toner developing method.

If the main motor 52 were driven for too long of a time while the submotor 54 is stopped before the image formation process, then both the developing roller 31 and the photosensitive drum 27 could be damaged by rubbing between the developing roller 31 and the photosensitive drum 27, thereby reducing their life. However, because the separating solenoid 56 is controlled to contact the developing roller 31 and the photosensitive drum 27 at the delayed timing described above, the submotor 54 can be stopped while the main motor 52 is driven with the developing roller 31 and the photosensitive drum 27 initially independent and not in contact with each other. For this reason, the amount that the developing roller 31 and the photosensitive drum 27 are damaged by being in contact with each other over longs periods of time can be reduced, so that the printer is more durable.

If the developing roller 31 is driven to rotate before the photosensitive drum 27 rotates one full turn from when the developing roller 31 and the photosensitive drum 27 are brought into contact with each other, then different areas of the surface of the photosensitive drum 27 would be polished by different amounts, so that filming could not be properly removed. However, according to the control of the present modification, the developing roller 31 is driven to rotate after the photosensitive drum 27 rotates one full turn from when the developing roller 31 and the photosensitive drum 27 are brought into contact with each other. Therefore, filming can be properly removed without generating variation in the polishing amount.

Figure 7:
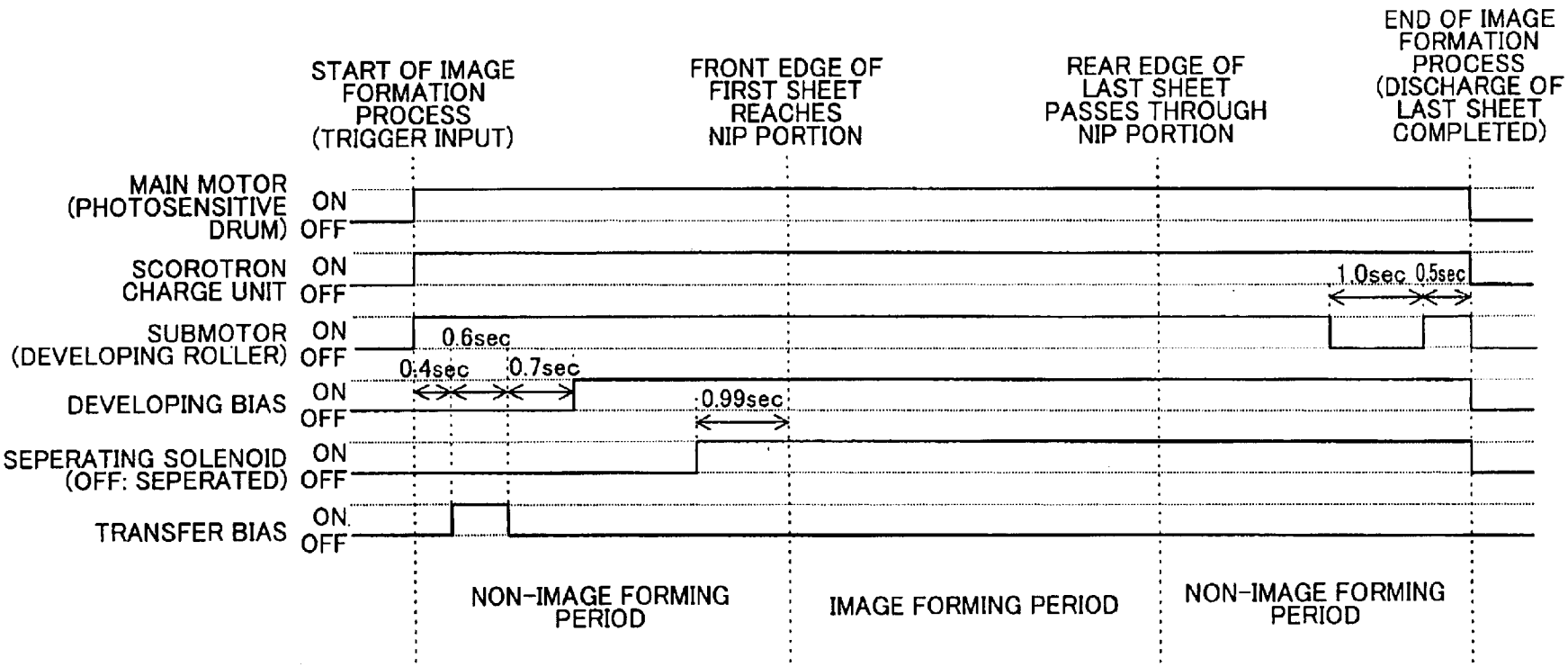
FIG. 7 is a timing chart showing drive timing of various components of the laser printer according to execution of a drive control program in order to remove filming after an image forming period and without use of a separation solenoid for separating the photosensitive drum and the developing roller from each other.

FIG. 7 shows a modification of the control sequences represented in FIGS. 5 and 6. In the controls represented in FIGS. 5 and 6, the separating solenoid 56 is used to separate, and bring into contact, the developing roller 31 and the photosensitive drum 27 at appropriate timings. However, FIG. 7 represents an example control used when no separating solenoid 56 is provided. In the modification of FIG. 7, after images are formed on sheets 3, drive of the submotor 54 is stopped and then restarted. Then, the main motor 52 and the submotor 54 are stopped simultaneously. It should be noted that alternatively the submotor 54 need not be stopped simultaneously with the main motor 52, but could be stopped after the main motor 52 is stopped.

It should be noted that FIG. 7 also indicates timing of when a transfer reverse bias is applied to the developing roller 31 in addition to the transfer bias. In the same manner as the transfer bias, the transfer reverse bias is applied to the developing roller 31 by the transfer bias application circuit 59 in accordance with on and off control by the drive control program stored in the ROM 62 of the CPU 51.

This control will be explained in more detail with reference to FIG. 7. Before an image formation process is started, all of the main motor 52, the scorotron charge unit 29, the submotor 54, developing bias, the transfer bias, and the transfer reverse bias are in an off or non-energized condition. When the CPU 51 receives a print job, it develops the print data from the print job into image data, such as bit map data. Afterward, a trigger indicating the start of the image formation process is input at a predetermined timing. Upon receiving input of the trigger, the CPU 51 turns on the main motor 52, the scorotron charge unit 29, and the submotor 54 to drive the photosensitive drum 27, various components for transporting sheets 3, and the developing roller 31, and to charge the surface of the photosensitive drum 27 to a uniform positive charge. After a predetermined time of 0.4 seconds elapses, the transfer reverse bias is turned on for 0.6 seconds so that the transfer roller 30 is applied with a reverse bias. As a result, the transfer roller 30 is cleaned because paper dust, toner and the like move from the transfer roller 30 to the photosensitive drum 27. The developing bias is turned off 0.7 seconds after the transfer reverse bias is turned on so that the developing bias is applied to the developing roller 31. Afterward, 0.99 seconds before the front edge of the first sheet 3 reaches the nip portion where the photosensitive drum 27 and the transfer roller 30 contact each other, the transfer bias is turned on so that the transfer bias is applied to the transfer roller 30. Visible toner images are transferred to sheets 3 that pass between the photosensitive drum 27 and the transfer roller 30. It should be noted that the timing at which the transfer bias is turned on is set as a predetermined time from the time that the sheet detection sensor (not shown) provided downstream from the registration rollers 12 detects the front edge of the first sheet 3.

The on and energized conditions of the main motor 52, the scorotron charge unit 29, the submotor 54, the developing bias, and the transfer bias are maintained until visible toner images are transferred to a number of sheets required by the present print job. It should be noted that the on or energized conditions are also maintained in between one sheet 3 and the next sheet 3.

After the end edge of the last sheet 3 passes through the nip portion where the photosensitive drum 27 contacts the transfer roller 30, but 1.5 seconds before the last sheet 3 is discharged, the submotor 54 is turned off so that rotation of the developing roller 31 is stopped. It should be noted that the timing at which the sub motor is turned off is set as a predetermined time from the time that a sheet discharge sensor (not shown) provided downstream from the registration rollers 12 detects the rear edge of the last sheet 3.

With this configuration, the submotor 54 is stopped while the main motor 52 is driven. Therefore, the surface of the rotating photosensitive drum 27 rubs against the stationary developing roller 31, so that any filming is rubbed off from the surface of the photosensitive drum 27.

The submotor 54 is again turned on after a predetermined time elapses. In this example, the predetermined time is 1.0 seconds, which is the time required for the photosensitive drum 27 to rotate once. The developing roller 31 is then again driven to rotate for a short time of 0.5 seconds, which is the time required for the developing roller 31 to rotate 2.5 times. Then simultaneously with complete discharge of the last sheet 3, the main motor 522, the scorotron charge unit 29, the submotor 54, the developing bias, and the transfer bias are all turned off. As a result, the image formation process is completed by stopping drive of the photosensitive drum 27 and of components for transporting sheets 3, the charging operation for charging the surface of the photosensitive drum 27, rotation of the developing roller developing roller 31, and application of the developing bias to the developing roller 31 and of the transfer bias to the transfer roller 30. It should be noted that the discharge of the last sheet 3 is detected by the sheet-discharge sensor (not shown) and the main motor 52 and the scorotron charge unit 29 are turned off based on the detection by the sheet-discharge sensor.

This control method can be applied when the photosensitive drum 27 rotates with a peripheral speed of 93 mm/sec (16 ppm), the photosensitive drum 27 has a diameter of 30 mm ϕ, and the developing roller 31 rotates with a peripheral speed of 158.1 mm/sec, which is 1.7 times the peripheral speed of the photosensitive drum 27.

This control can be achieved without provided any new special components so that the image forming device can be made in a compact size and less expensively. Also, the surface of the rotating photosensitive drum 27 can be rubbed against the stopped developing roller 31 so that filming can be properly removed from the surface of the photosensitive drum 27. By controlling the developing roller 31 to stop without changing its rotational speed, the toner layer is stably formed on the surface of the developing roller 31 while the developing roller 31 is in the process of stopping. Accordingly, an optimal toner layer is always formed on the surface of the developing roller 31 so that proper image formation can be performed using the non-magnetic, single-component toner developing method.

When the photosensitive drum 27 rotates against the stopped developing roller 31, the photosensitive drum 27 scrapes the toner from the surface of the developing roller 31 that is in confrontation with the photosensitive drum 27 when the submotor 54 is stopped. As a result, the surface of the photosensitive drum 27 and the developing roller 31 are brought into direct contact with each other, with no intervening layer of toner. Because no separating solenoid 56 is provided, the developing roller 31 and the photosensitive drum 27 are in contact with each other after their rotation is stopped. If left in this condition, the surface of the photosensitive drum 27 could be stained or indentations could be formed in the surface of the developing roller 31.

However, in the modification shown in FIG. 7, after the submotor 54 is temporarily stopped so that the contact between the developing roller 31 and the photosensitive drum 27 polishes filming from the photosensitive drum 27, the submotor 54 is again driven for a short time and then stopped simultaneously with the main motor 52. With this configuration, the portion where the toner was scraped from the developing roller 31 by the photosensitive drum will be shifted away from the photosensitive drum 27 when the developing roller 31 and the photosensitive drum 27 are both stopped. As a result, the surface of the developing roller 31 will contact the photosensitive drum 27 through a layer of toner borne on the surface of the developing roller 31, so that the developing roller 31 and the photosensitive drum 27 can be left in contact with each other without the photosensitive drum 27 becoming stained or the developing roller 31 developing any indentations on its surface. Accordingly, filming can be properly removed without providing the separating solenoid 56.

It should be noted that although the control represented by the timing chart in FIG. 7 rotates the developing roller 31 by 2.5 turns to shift the abrasion portion of the developing roller 31 from the photosensitive drum 27, then developing roller 31 need only be rotated slightly to achieve this objective.

In the control methods represented in FIGS. 5 to 7, when the surface of the rotating photosensitive drum 27 is abraded against the stopped developing roller 31, the photosensitive drum 27 scrapes the toner off from the developing roller 31. The scraped off toner can cling to and stain other components. Also, when all toner is scraped from the developing roller 31 where the photosensitive drum 27 rubs against the developing roller 31, the direct contact between the developing roller 31 and the photosensitive drum 27 can stain the photosensitive drum 27. However, because the laser printer 1 uses polymerized toner, which has excellent fluidity, the amount of friction between the developing roller 31 and the photosensitive drum 27 is reduced. The toner is not easily scraped off the developing roller 31 by the photosensitive drum 27. Toner can be prevented from clinging to other components. The photosensitive drum 27 can be prevented from becoming stained as a result of direct contact between the developing roller 31 and the photosensitive drum 27 causes by absence of toner at the position where the photosensitive drum 27 rubs against the developing roller 31.

Moreover, because the toner is adjusted to have a charge-to-mass ratio Q/M with an absolute value of 10 micro coulombs/gram or greater, imaging forces are increased so the toner clings to the developing roller 31 with greater force. For this reason, toner is even more difficult for the photosensitive drum 27 to scrape up even though the photosensitive drum 27 rubs against the developing roller 31. Problems such as scraped off toner clinging to and staining other components and the photosensitive drum 27 being stained by direct contact between the developing roller 31 and the photosensitive drum 27 when no toner is present at the abrading position of the developing roller 31 can be prevented.

The developing roller 31 of the laser printer 1 is formed from a two-layer configuration that includes a resilient roller portion and a surface coat layer. The surface coat layer covers the surface of the roller portion and has a hardness greater than the hardness of the roller portion. With this configuration, the life of both the photosensitive drum 27 and the developing roller 31 can be increased because neither will be greatly damaged by abrasion when the developing roller 31 stops rotating.

That is, if the developing roller 31 where formed from only a single layer of a resilient material with high hardness, then the developing roller 31 would need to be pressed against the photosensitive drum 27 with a high pressing force in order to assure that contact between the developing roller 31 and the photosensitive drum 27 is uniform across the entire width of the photosensitive drum 27. If the developing roller 31 is pressed with great force against the photosensitive drum 27, then the photosensitive drum 27 will be greatly damaged by abrasion when the developing roller 31 stops rotating. This would reduce the life of the photosensitive drum 27. On the other hand, if the developing roller 31 where formed from only a single layer of a resilient material with low hardness, then the developing roller 31 would be greatly damaged by abrasion when the developing roller 31 stops, so that the life of the developing roller 31 would be greatly reduced.

However, with the two-layer configuration of the embodiment and its modifications, the developing roller 31 and the photosensitive drum 27 contact each other uniformly across their entire width even if the developing roller 31 is pressed against the photosensitive drum 27 with a weak force. For this reason, the photosensitive drum 27 receives only slight damage by abrasion when the developing roller 31 stops. Life of the photosensitive drum 27 can be increased. Also, the surface coat layer of the developing roller 31 is very hard, so that the developing roller 31 is only slightly damaged by abrasion when the developing roller 31 stops. Life of the developing roller 31 can be increase also.

The photosensitive layer of the photosensitive drum 27 is made from a dispersion-type, single layer, organic photosensitive body. Because the photosensitive layer includes only a single layer, the photosensitive drum 27 is easier to produce than a two-layer photosensitive drum that has a charge-transfer layer formed on a charge-generating layer. However, because the charge-generating material is near the surface in the single-layer photosensitive layer of the photosensitive drum 27, the photosensitive drum 27 degrades more easily that the two-layer photosensitive drum. However, because the surface of the photosensitive drum 27 is polished by the developing roller 31 as a result of the control methods of the embodiment and its modifications, stable images can always be formed over long periods of time.

According to the control methods represented in FIGS. 5 to 7, when the drive of the submotor 54 is stopped, the surface of the photosensitive drum 27 that presses against the developing roller 31 includes a uniform charge from the scorotron charge unit 29, because it was not exposed by the scanner unit 16. Also, the developing roller 31 is applied with the developing bias in the same way as during image formation. In other words, the surface of the photosensitive drum 27 has an unexposed portion in the same manner as during normal image formation. Therefore, the toner will be held on the developing roller 31 by the electric field generated between the electric potential at the surface of the photosensitive drum 27 and the developing bias of the developing roller 31. For this reason, the toner is difficult to scrape off from the developing roller 31 by the photosensitive drum 27 even if the photosensitive drum 27 rubs against the developing roller 31. Problems such as scraped off toner clinging to and staining other components and the photosensitive drum 27 being stained by direct contact between the developing roller 31 and the photosensitive drum 27 when no toner is present at the abrading position of the developing roller 31 can be prevented.

Next, a color laser printer 71 according to a second embodiment of the present invention will be described while referring to FIG. 8. The color laser printer 71 includes the same drive control system shown in FIG. 4 and can be driven according to any of the controls represented in FIGS. 5 to 7.

The color laser printer 71 includes a casing 72, a feeder portion 74, an image forming portion 75, and an inverse transport portion 76. The feeder portion 74, the image forming portion 75, and the inverse transport portion 76 are provided in the casing 72. The feeder portion 74 is for feeding sheets 73. The image forming portion 75 is for forming images on the fed out sheets 73. The inverse transport portion 76 is for forming images on both sides of the sheets 73.

The feeder portion 74 includes a sheet-supply tray 77, a sheet-pressing plate 81, a sheet-feed roller 78, transport rollers 79, and registration rollers 80. The sheet-supply tray 77 is detachably mounted in the lower portion in the casing 72. The sheet-feed roller 78 is disposed above one end of the sheet-supply tray 77. The transport rollers 79 are disposed downstream from the sheet-feed roller 78. The registration rollers 80 are provided downstream from the transport rollers 79. The sheet-pressing plate 81 is provided in the sheet-supply tray 77 and is disposed so that the end portion in confrontation with the sheet-feed roller 78 can move up and down. Sheets 73 are stacked in a pile on the sheet-pressing plate 81. A spring (not shown) urges the sheet-pressing plate 81 from the under surface of the sheet-pressing plate 81 so that the uppermost sheet 73 of the pile is pressed toward the sheet-feed roller 78. Rotation of the sheet-feed roller 78 feeds out one sheet at a time from the pile. Each sheet 73 that is fed out by the sheet-feed roller 78 is transported by the transport rollers 79 to the registration rollers 80. After the registration rollers 80 perform a registration operation on the sheet 73, the sheet is transported to the image forming portion 75.

The image forming portion 75 includes process portions 82, an intermediate transfer mechanism 83, a secondary transfer roller 84, and a fixing unit 85.

A process portion 82 is provided for each of four printing colors. The process portions 82 are provided in vertical alignment separated from each other by a predetermined spacing. Each process portion 82 includes a developing cartridge 86, a photosensitive drum 87, a scorotron charge unit 88, an LED array 89, which serves as an exposure unit, a primary transfer roller 90, and a drum cleaner 91.

Each developing cartridge 86 is detachably mounted to other components of the corresponding process portion 82 and includes a toner holding portion 92, a supply roller 93, a developing roller 94, and a layer-thickness regulating blade 95. In the present embodiment, four developing cartridges 86 are provided, that is, a yellow developing cartridge 86Y, a magenta developing cartridge 86M, a cyan developing cartridge 86C, and a black developing cartridge 86K. Also, the separating solenoid 56 described in the previous embodiment is provided for each developing cartridge 86 so that each developing cartridge 86 can be slid forward and backward in order to separate the developing cartridge 86 from, and move the developing cartridge 86 toward, the corresponding process portion 82.

The toner holding portion 92 of each developing cartridge 86 is filled with a non-magnetic, single-component toner with positively charging properties. Each toner holding portion 92 holds a different colored toner, that is, the toner holding portion 92 of the yellow developing cartridge 86Y holds yellow toner, the toner holding portion 92 of the magenta developing cartridge 86M holds magenta toner, the toner holding portion 92 of the cyan developing cartridge 86C holds cyan toner, and the toner holding portion 92 of the black developing cartridge 86K holds black toner. Each different-color toner is a polymerized toner with a charge-to-mass ratio Q/M having an absolute value of 10 micro coulombs/gram or greater.

Each toner holding portion 92 includes an agitator 96 and is formed with a toner-supply opening in its side. The agitator 96 agitates the toner in the toner holding portion 92 and discharges the toner from a toner-supply opening to the corresponding supply roller 93.

Each supply roller 93 is rotatably disposed to the side of the corresponding toner supply opening in the corresponding toner holding portion 92. Each developing roller 94 is rotatably disposed in confrontation with the corresponding supply roller 93 so that the supply roller 93 and the developing roller 94 are in abutment with each other, with the supply roller 93 compressed by a certain amount.

Each supply roller 93 is formed from a metal roller shaft covered by a conductive sponge member.

Each developing roller 94 is made from a metal roller shaft covered by a resilient member, which is made from conductive rubber. More specifically, the roller of each developing roller 94 has a two-layer configuration including a roller portion and a surface coat layer. The roller portion is formed from a conductive resilient material such as EPDM rubber, silicon rubber, urethane rubber incorporated with, for example, carbon particles. The surface coat layer covers the surface of the roller portion. The surface coat layer has a greater hardness than the roller portion. Examples of the main component of the surface coat layer include urethane rubber, urethane resin, and polyimide resin.

The submotor shown in FIG. 4 is provided for driving the developing rollers 94. The developing bias application circuit 58 shown in FIG. 4 applies a predetermined developing bias to the developing rollers 94.

Each layer-thickness regulating blade 95 is disposed near the corresponding developing roller 94. Each layer-thickness regulating blade 94 includes a metal plate spring and a pressing portion attached to the free end of the plate spring. The pressing portion is formed from silicon rubber, which has electrical insulation properties. The pressing portion has a half circle shape in cross section. Each layer-thickness regulating blade 94 is supported on the corresponding developing cartridge 86 at a position near the corresponding developing roller 95 so that the pressing portion is pressed against the developing roller 95 by resiliency of the plate spring.

Rotation of each supply roller 93 supplies the toner from the toner supply opening to the corresponding developing roller 94, where friction between the supply roller 93 and developing roller 94 charges the toner to a positive charge. The toner borne on each developing roller 94 enters between the developing roller 94 and the pressing portion of the corresponding layer-thickness regulating blade 95 in association with rotation of the developing roller 94, where the toner is sufficiently charged by friction between the pressing portion and the developing roller 94 and regulated to a thin layer with a uniform thickness on the developing roller 94.

Each photosensitive drum 87 is disposed to the side of the corresponding developing roller 94 and is rotatably in contact with the developing roller 94. The drum body of each photosensitive drum 87 is grounded. The surface of each photosensitive drum 87 is formed from a photosensitive layer of a dispersion-type, single layer, organic photosensitive body. A charge generating material is dispersed in the charge transporting layer. Also, the main motor 52 shown in FIG. 4 drives rotation of the photosensitive drums 87.

Each scorotron charge unit 88 is disposed to the side of the corresponding photosensitive drum 87, separated by a predetermined distance from the photosensitive drum 81 so as not to contact the photosensitive drum 87. The scorotron charge units 88 are scorotron charge units that, in order to positively charge the surface of the photosensitive drums 87, generate a corona discharge from a charge wire made from tungsten, for example. Each scorotron charge unit 88 charges the surface of the corresponding photosensitive drum 87 to a uniform positive charge. The scorotron charge units 88 are controlled to charge by the charge control circuit 60 shown in FIG. 4.

Each LED 89 is disposed to the side of the corresponding photosensitive drum 87 and is disposed in between the scorotron charge unit 88 and the developer roller 94 with respect to the rotational direction of the photosensitive drum 87. Each LED array 89 is configured from a plurality of LEDs aligned in a row, The LEDs emit light based on image data and irradiate and expose the surface of the corresponding photosensitive drum 87.

The process portions 82 perform exposure and development processes in substantially the same manner, but for the different toner colors. Here, exposure and development processes will be described for a representative process portion 92. As the photosensitive drum 87 rotates, the scorotron charge unit 88 charges the surface of the photosensitive drum 87 uniformly to a positive charge, and the LED array 69 emits light to expose the surface of the photosensitive drum 87, thereby forming a static-electric latent image based on image data on the surface of the photosensitive drum 87. Next, as the developing roller 94 confronts and contacts the photosensitive drum 87, rotation of the developing roller 94 supplies positively-charged toner that is borne on the developing roller 94 to the static-electric latent image formed on the surface of the photosensitive drum 87. At this time, the toner is selectively borne on only portions of the photosensitive drum 87 that were exposed by the LED array 89. That is, when the LED array 89 exposes portions of the uniformly positively charged surface of the photosensitive drum 87, the electric potential drops at the exposed portion. The supplied toner is selectively transferred to only the exposed portions, thereby developing the static-electric latent image into a visible toner image. Thus, an inverse development operation is performed.

Each primary transfer roller 90 is disposed at a position downstream from the corresponding developing roller 94 with respect to the rotational direction of the photosensitive drum 87. Each primary transfer roller 90 is disposed in confrontation with the corresponding photosensitive drum 87, with an endless belt 100 to be described later sandwiched between the photosensitive drum 87 and the developing roller 94. Each primary transfer roller 90 is made from a metal roller shaft covered with a conductive rubber material. Each primary transfer roller 90 is rotated by drive from the corresponding photosensitive drum 87. The transfer bias application circuit 59 shown in FIG. 4 applies a predetermined transfer bias to the transfer rollers 90 with respect to the corresponding photosensitive drum 87, so that the visible toner image borne on the photosensitive drums 87 is transferred to the endless belt 100 that passes between the photosensitive drums 87 and the primary transfer rollers 90.

The drum cleaners 91 are for collecting residual toner from the photosensitive drums 87. Each drum cleaner 91 is disposed between the corresponding primary transfer roller 90 and the corresponding scorotron charge unit 88 with respect to the rotational direction of the photosensitive drum 87. Each drum cleaner 91 has a box shape formed with an opening where it confronts the photosensitive drum 87. A scraping blade 97 is provided in the opening. The free end of the scraping blade 97 contacts the surface of the photosensitive drum 87. Residual toner that remains on the surface of the photosensitive drum 87 after the visible toner image is transferred is scraped off from the photosensitive drum 87 by the scraping blade 97 and collected inside the drum cleaner 91.

The intermediate transfer mechanism 83 is disposed in the casing 72 so as to extend vertically in confrontation with the photosensitive drums 87. The intermediate transfer mechanism 83 includes first and second rollers 98, 99, and the endless belt 100. The first roller 98 is provided at the bottom side of the intermediate transfer mechanism 83 and the second roller 99 is provided at the upper side of the intermediate transfer mechanism 83. The endless belt 100 is wound around the outer periphery of the first and second rollers 98, 99. The surface of the endless belt 100 that receives transfer of the visible toner image moves downward as indicated by the arrow in FIG. 8 by rotation of the first and second rollers 98, 99.

Rotation of the first and second rollers 98, 99 moves any particular portion of the endless belt 100 serially into an out of confrontation with the different photosensitive drums 87. The visible toner images formed on the different photosensitive drums 87 are transferred one at a time in order onto the endless belt 100. When the different visible toner images become superimposed on each other in this way, a color image results. Described in more detail, after the yellow visible toner image formed on the photosensitive drum 87 by the yellow toner that fills the yellow developing cartridge 86Y is transferred onto the endless belt 100, then the magenta visible toner image formed on the photosensitive drum 87 by the magenta toner that fills the magenta developing cartridge 86Y is transferred onto the endless belt 100 so as to overlap the yellow toner image. In a similar manner, the cyan visible toner image formed by toner from the cyan developing cartridge 86K and the black visible toner image formed by toner from the black developing cartridge 86K are transferred in this order onto the endless belt 100 to form a color image on the endless belt 100.

The secondary transfer roller 84 is rotatably provided at a position in confrontation with the first roller 98 of the intermediate transfer mechanism 83, with sheets 73 sandwiched therebetween. The secondary transfer roller 84 is formed from a metal roller shaft covered by a conductive rubber material. The secondary transfer roller 84 is applied with a predetermined transfer bias. The color image formed on the endless belt 100 is transferred all at once onto a sheet 73 that passes between the endless belt 100 and the secondary transfer roller 99.

The fixing portion 85 is disposed downstream from the secondary transfer roller 84 with respect to the transport direction of the sheet 73. The fixing portion 85 includes a pair of thermal rollers 101, 102 and a pair of transport rollers 103. The thermal rollers 101, 102 are disposed so as to press against each other, The pair of transport rollers 103 are provided downstream from the thermal rollers 101, 102 in the direction of sheet transport. The thermal rollers 101, 102 are each made from metal and include a halogen lamp for generating heat. The color image transferred onto a sheet 73 by the secondary transfer roller 84 is heatedly fixed onto the sheet 73 as the sheet 73 passes between pair of thermal rollers 101, 102. Afterward, the transport rollers 103 transport the sheet 73 to a discharge path 104.

The discharge path 104 is provided following the vertical direction of the casing 72. Two pairs of transport rollers 105 and 106 are provided exposed into the discharge path 104. A pair of sheet-discharge rollers 107 are provided at the discharge port of the discharge path 104.

A sheet 73 that has been transported to the discharge path 104 by the transport rollers 103 of the fixing portion 85 is transported by the transport rollers 105 and 106 and discharged onto the discharge tray 108 by the sheet-discharge rollers 107.

The inverted transport portion 76 includes an inverted transport path 108 and a flapper 110. The flapper 110 switches direction in which sheets 73 are transported. The inverted transport path 109 is connected at one end to the discharge path 104 at a position near the transport rollers 105 and at the other end to the sheet transport path that extends between the transport rollers 79 and the registration rollers 80. Also two pairs of inverted transport rollers 111, 112 are disposed so as to be exposed in the inverted transport path 109.

The flapper 110 is swingably provided at the junction of the discharge path 104 and the inverted transport path 109. Although not shown in the drawings, a path switching solenoid is provided for switching the flapper 110 back and forth. That is, by selectively energizing and not energizing the path switching solenoid, the transport direction of a sheet 73 that has a color image formed on one side can be switched to the discharge path 104 or from the discharge path 104 to the inverted transport path 109.

Next, operations for forming images on both sides of a sheet 73 will be described. Once a sheet 73 formed with an image on one side is transported from the discharge path 104 to the sheet-discharge rollers 107, then the sheet-discharge rollers 107 rotate forward with the sheet 73 sandwiched therebetween, so that the sheet 73 is transported out from the printer 71 toward the discharge tray 108. The sheet 73 is transported most of the way out from the printer 71 until the end edge of the sheet 73 is sandwiched between the sheet-discharge rollers 107. Then, the positive rotation of the sheet-discharge rollers 107 is stopped and the sheet-discharge rollers 107 are driven to rotate in the opposite direction. At this time, the solenoid is energized to switch the flapper 110 to guide the sheet 73 to the inverted transport path 109. The transport rollers 104, 105 are also driven to rotate in the opposite direction to transport the sheet 73 backwards, with front and rear edges reversed, downward toward the inverted transport path 109. It should be noted that once transport of the sheet 73 into the inverted transport path 109 is completed, the flapper 110 is switched back into its initial position for guiding sheets 73 from the transport rollers 103 toward the sheet-discharge path 104. The inverted transport rollers 111, 112 transport the sheet 73 that was transported backwards into the inverted transport path 109 to the registration rollers 80, which subject the sheet 73 to a registration operation. Then the sheet is again formed with an image while in an upside down condition, so that an image is formed on both sides of the sheet 73.

A belt cleaner 113 is provided for collecting toner that remains on the endless belt 100 after the entire color image is transferred onto the sheet 73 at the same time. The belt cleaner 113 is disposed to the side of the intermediate transfer mechanism 83 and includes a cleaner casing 114, a cleaner brush 115, a collection roller 116, a collection box 117, and a scraping blade 118. The cleaner casing 114 is disposed between the first roller 98 and the second roller 99 and houses the other components of the belt cleaner 113.

The cleaner brush 115 is made from a cylindrical body formed with radially extending filaments. The cleaner brush 115 is rotatably disposed in confrontation with and in contact with the endless belt 100. A bias is applied to the cylindrical body so as to develop a predetermined potential difference between the cleaner brush 115 and the endless belt 100.

The collection roller 116 is formed from a metal roller and is rotatably disposed below the cleaner brush 115 so as to be in confrontation with and in contact with the filaments of the cleaner brush 115. The collection roller 116 is applied with a bias so as to develop a predetermined bias between the collection roller 116 and the cleaner brush 115.

The collection box 117 is provided below the collection roller 116 and has an opening that faces the collection roller 116. The scraping blade 138 is provided near the opening in pressing contact with the collection roller 116.

When the endless belt 100 is transported into confrontation with the cleaner brush 115, the cleaner brush 115 scrapes toner that remains on the endless belt 100 after the color image is transferred onto the sheet 73. Also the toner clings to the cleaner brush 115 because of the bias applied to the cleaner brush 115. Afterward, because of the bias applied to the collection roller 116, the toner that clings to the cleaner brush 115 clings to the collection roller 116 when it is brought into confrontation with the collection roller 116. Next, the scraping blade 118 scrapes the toner off from the collection roller 116 into the collection box 117.

The color laser printer 71 also uses the control system shown in FIG. 4 and a control program for executed any of the control methods represented by FIGS. 5 to 7 to operate all of the components at appropriate timings to remove filming from the photosensitive drums 87.

The color laser printer 71 includes a photosensitive drum 87 and a developing roller 94 for each color. The visible toner images formed for different colors are transferred in order. This is referred to as a tandem type color laser printer, which can form a color image at substantially the same speed as a monochrome image. Further, because the tandem-type color laser printer 71 uses polymerized toner, color images with extremely high quality can be formed.

On the other hand, because the tandem-type color laser printer 71 has a photosensitive drum 87 and developing roller 94 for each color, there is a potential problem that toner that was transferred from a photosensitive drum 87 to the endless belt 100 can cling to a succeeding photosensitive drum 87. For example, the yellow toner of the yellow color image on the endless belt 100 can cling to the photosensitive drum 87 that is for producing the magenta color image. As a result, different color toners can be mixed together. To avoid this potential problem, it is essential that the scraping blade 97 of each drum cleaner 91 scrape off toner completely.

However, because of polymerized toner's high fluidity, the scraping blade 97 cannot easily scrape the residual toner off from the photosensitive drum 87. Although filming is more likely to occur on the surface of the photosensitive drums 87 as a result, using the drive control methods described in the first embodiment and its modifications enables the filming to be properly removed from the surface of the photosensitive drum 87.

Because the tandem-type color laser printer 71 includes a separate photosensitive drum 87 and a developing roller 94 for each color, if a separate member was provided for removing filming from the photosensitive drums, a separate member would need to be provided for each photosensitive drum, which would be extremely difficult. However, the control methods described in the first embodiment and its modifications enable proper removal of filming without providing a separate filming-removal member for each photosensitive drum.

Figure 8:
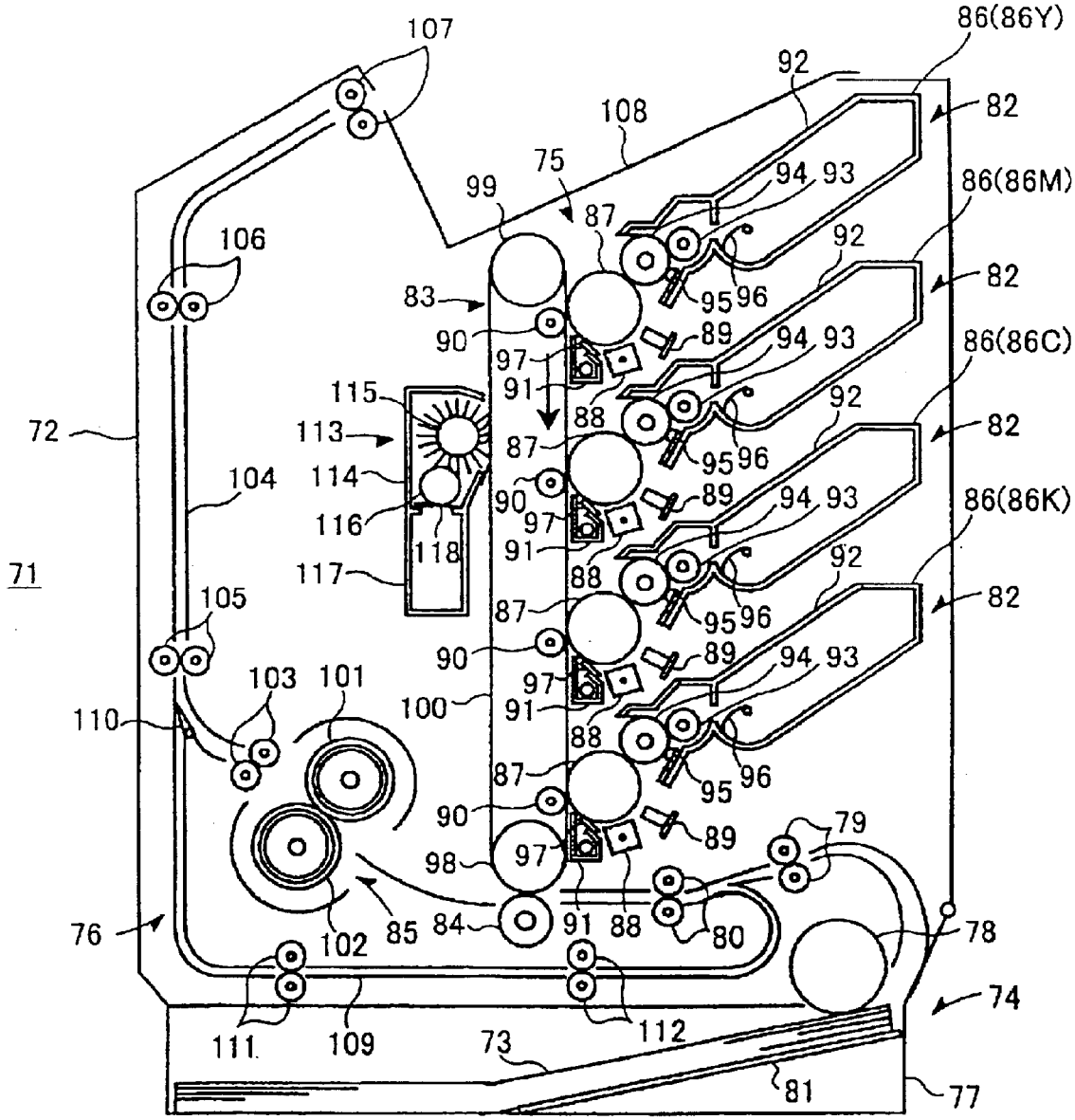
FIG. 8 is cross-sectional view showing a full color laser printer according to a second embodiment of the present invention.

It should be noted that the intermediate transfer mechanism 83 need not be provided, That is, in the embodiment of FIG. 8, the different-color visible toner images borne on the different photosensitive drums are first transferred onto the endless belt 100 to form a full color image on the endless belt 100. Then, using the secondary transfer roller 84, the full color image is transferred from the endless belt 100 onto a sheet 73. However, depending on the objectives and applications of the laser printer 83, the full visible toner images could be transferred directly from the different-color photosensitive drums 87 to a sheet 73 that passes between the primary transfer rollers 90 and the photosensitive drums 87, so that the full color image is formed directly on the sheet 73.

What is claimed is:

1. An image forming device comprising:

a photosensitive drum adapted for supporting a static-electric latent image on its surface;

a developing roller adapted to bear developer, the developing roller being disposed in confrontation and in contact with the surface of the photosensitive drum;

a photosensitive drum driver that drives rotation of the photosensitive drum;

a developing roller driver that drives rotation of the developing roller;

a drive controller that controls the developing roller driver to stop driving the developing roller and maintain the developing roller in a non-rotating condition while controlling the photosensitive drum driver to drive the photosensitive drum to rotate, the drive controller also controlling the photosensitive drum driver to start rotation of the photosensitive drum when the developing roller is stopped;

a charge unit that charges the surface of the photosensitive drum to a uniform charge;

an exposure unit that exposes the uniformly-charged surface of the photosensitive drum to form the static-electric latent image on the surface of the photosensitive drum; and a developing bias application unit that applies a developing bias to the developing roller during image forming periods, wherein the drive controller, during the portion of the non-image forming period when the drive controller controls the developing roller driver to stop driving and the photosensitive drum driver to drive, controls:

the charge unit to uniformly charge the surface portion of the photosensitive drum;

the exposure unit to not perform exposing operations; and the developing bias application unit to apply a bias to the developing roller the same as the developing bias applied during image forming periods.

2. An image forming device as claimed in claim 1, wherein the developer is a polymerized toner produced by polymerizing a monomer that has polymerizing properties.

3. An image forming device as claimed in claim 2, further comprising:

a visible image transfer unit that transfers the visible image from the photosensitive drum onto another medium; and a toner cleaning member in contact with the photosensitive drum and for removing residual toner that remains on the photosensitive drum after the visible image transfer unit transfers the visible image from the photosensitive drum onto the other medium.

4. An image forming device as claimed in claim 1, wherein the developing roller includes:

a resilient roller portion; and a surface coat layer covering the roller portion and having a hardness greater than hardness of the roller portion.

5. An image forming device as claimed in claim 1, wherein the developer has a charge-to-mass ratio Q/M having an absolute value of 10 micro coulombs/gram or greater.

6. An image forming device as claimed in claim 1, wherein the photosensitive drum has a photosensitive layer formed from a dispersion-type, single layer, organic photosensitive material.

7. An image forming device as claimed in claim 1 further comprising a rotation prevention mechanism that blocks rotation of the developing roller while the drive controller controls the developing roller driver to stop driving the developing roller.

8. An image forming device as claimed in claim 1, further comprising a visible image transfer unit that transfers the visible image from the photosensitive drum onto another medium, the drive controller controlling, during a non-image forming period after the visible image transfer unit transfers the visible image from the photosensitive drum, the developing roller driver to stop driving first and then the photosensitive drum driver to stop driving.

9. An image forming device as claimed in claim 1 further comprising a visible image transfer unit that transfers the visible image from the photosensitive drum onto another medium, the drive controller controlling, during a non-image forming period before the visible image transfer unit transfers the visible image from the photosensitive drum onto the medium, the photosensitive drum driver to start driving first and then the developing roller driver to start driving.

10. An image forming device as claimed in claim 1, further comprising a plurality of photosensitive drums and developing rollers for producing a plurality of image colors.

11. An image forming device as claimed in claim 1, wherein the developing roller is adapted to bear nonmagnetic, single component developer for developing the static-electric latent image on the photosensitive drum into a visible image.

12. An image forming device as claimed in claim 1, wherein the drive controller controls the developing roller driver to stop driving the developing roller and maintain the developing roller in a non-rotating condition during at least a portion of a non-image forming period in an image formation process.

13. A method of removing film from the surface of a photosensitive drum that is in contact with a developing roller, the method comprising:

starting rotation of the photosensitive drum while the developing roller is maintained in a non-rotating condition so that surface of the photosensitive drum rubs against the developing roller;

subsequently starting rotation of the developing roller; and subsequently stopping rotation of the developing roller into a non-rotating condition so that surface of the still-rotating photosensitive drum rubs against the developing roller, wherein the step of subsequently stopping rotation of the developing roller is performed during a non-image forming period after a rear edge of a last sheet passes through a nip portion between the photosensitive drum and a transfer roller.

14. A method as claimed in claim 13, wherein the rotation of the photosensitive drum is started in accordance with a command to start an image formation process.

15. A method as claimed in claim 13, further comprising a step of separating the photosensitive drum and the developing roller from each other that is performed one of simultaneously with and prior to the step of subsequently stopping rotation of the developing roller.

16. A method as claimed in claim 13, wherein the step of subsequently starting rotation of the developing roller is performed during a non-image forming period before a front edge of a first sheet passes through a nip portion between the photosensitive drum and a transfer roller.

17. A method of removing film from the surface of a photosensitive drum that is in contact with a developing roller, the method comprising:

starting rotation of the photosensitive drum and the developing roller substantially simultaneously; and subsequently stopping rotation of the developing roller to bring the developing roller into a non-rotating condition while maintaining the photosensitive drum in a rotating condition so that surface of the photosensitive drum rubs against the developing roller, wherein the step of subsequently stopping rotation of the developing roller is performed during a non-image forming period after a rear edge of a last sheet passes through a nip portion between the photosensitive drum and a transfer roller.

18. An image forming device comprising:

a photosensitive drum adapted for supporting a static-electric latent image on its surface;

a developing roller adapted to bear developer, the developing roller being disposed in confrontation and in contact with the surface of the photosensitive drum;

a photosensitive drum driver that drives rotation of the photosensitive drum;

a developing roller driver that drives rotation of the developing roller;

a drive controller that controls the developing roller driver to stop driving the developing roller and maintain the developing roller in a non-rotating condition while controlling the photosensitive drum driver to drive the photosensitive drum to rotate, the drive controller also controlling the photosensitive drum driver to start rotation of the photosensitive drum when the developing roller is stopped; and a visible image transfer unit that transfers the visible image from the photosensitive drum onto another medium, the drive controller controlling, during a non-image forming period after the visible image transfer unit transfers the visible image from the photosensitive drum, the developing roller driver to stop driving first and then the photosensitive drum driver to stop driving, wherein the drive controller controls, from a condition wherein both the photosensitive drum driver and the developing roller driver are driving, the developing roller driver to stop driving, then the developing roller driver to again drive, then the photosensitive drum driver to stop driving and controls the developing roller driver to stop driving at a time, the time being one of simultaneously and afterward.

19. An image forming device as claimed in claim 18, wherein the developer is a polymerized toner produced by polymerizing a monomer that has polymerizing properties.

20. An image forming device as claimed in claim 19, further comprising:

a visible image transfer unit that transfers the visible image from the photosensitive drum onto another medium; and a toner cleaning member in contact with the photosensitive drum and for removing residual toner that remains on the photosensitive drum after the visible image transfer unit transfers the visible image from the photosensitive drum onto the other medium.

21. An image forming device as claimed in claim 18, wherein the developing roller includes:

a resilient roller portion; and a surface coat layer covering the roller portion and having a hardness greater than hardness of the roller portion.

22. An image forming device as claimed in claim 18, wherein the developer has a charge-to-mass ratio Q/M having an absolute value of 10 micro coulombs/gram or greater.

23. An image forming device as claimed in claim 18, wherein the photosensitive drum has a photosensitive layer formed from a dispersion-type, single layer, organic photosensitive material.

24. An image forming device as claimed in claim 18 further comprising a rotation prevention mechanism that blocks rotation of the developing roller while the drive controller controls the developing roller driver to stop driving the developing roller.

25. An image forming device as claimed in claim 18, further comprising a visible image transfer unit that transfers the visible image from the photosensitive drum onto another medium, the drive controller controlling, during a non-image forming period before the visible image transfer unit transfers the visible image from the photosensitive drum onto the medium, the photosensitive drum driver to start driving first and then the developing roller driver to start driving.

26. An image forming device as claimed in claim 18, further comprising a plurality of photosensitive drums and developing rollers for producing a plurality of image colors.

27. An image forming device as claimed in claim 18, wherein the developing roller is adapted to bear nonmagnetic, single component developer for developing the static-electric latent image on the photosensitive drum into a visible image.

28. An image forming device as claimed in claim 18, wherein the drive controller controls the developing roller driver to stop driving the developing roller and maintain the developing roller in a non-rotating condition during at least a portion of a non-image forming period in an image formation process.

29. An image forming device comprising:

a photosensitive drum adapted for supporting a static-electric latent image on its surface;

a developing roller adapted to bear developer, the developing roller being disposed in confrontation and in contact with the surface of the photosensitive drum;

a photosensitive drum driver that drives rotation of the photosensitive drum;

a developing roller driver that drives rotation of the developing roller, the photosensitive drum and the developing roller being contactable with each other and separable from each other; and a drive controller that controls the developing roller driver to stop driving the developing roller and maintain the developing roller in a non-rotating condition while controlling the photosensitive drum driver to drive the photosensitive drum to rotate, the drive controller also controlling the photosensitive drum driver to start rotation of the photosensitive drum when the developing roller is stopped;

the drive controller also controlling the photosensitive drum driver and the developing roller driver to rotate the photosensitive drum at least once while the developing roller and the photosensitive roller are in contact with each other and then to stop the rotation of the photosensitive drum after stopping rotation of the developing roller.

30. An image forming device as claimed in claim 29, further comprising a contact/separating unit that selectively brings the photosensitive drum and the developing roller into contact with each other and separates the photosensitive drum and the developing roller, the contact/separating unit separating the photosensitive drum and the developing roller from each other after the photosensitive drum is rotated at least once, the photosensitive drum driver stopping the rotation of the photosensitive drum after the separation.

31. An image forming device, comprising:

a photosensitive drum adapted for supporting a static-electric latent image on its surface;

a developing roller adapted to bear developer, the developing roller being disposed in confrontation and in contact with the surface of the photosensitive drum;

a photosensitive drum driver that drives rotation of the photosensitive drum;

a developing roller driver that drives rotation of the developing roller, the photosensitive drum and the developing roller being contactable with each other and separable from each other;

a drive controller that controls the developing roller driver to stop driving the developing roller and maintain the developing roller in a non-rotating condition while controlling the photosensitive drum driver to drive the photosensitive drum to rotate, the drive controller also controlling the photosensitive drum driver to start rotation of the photosensitive drum when the developing roller is stopped;

the drive controller also controlling the photosensitive drum driver and the developing roller driver to start rotation of the developing roller after the photosensitive drum starts rotation and rotates at least once.

32. An image forming device as claimed in claim 31, further comprising a contact/separating unit that selectively brings the photosensitive drum and the developing roller into contact with each other and separates the photosensitive drum and the developing roller, the drive controller also controlling the photosensitive drum driver to rotate the photosensitive drum while the photosensitive drum and the developing roller are separated from each other, and the drive controller also controlling the developing roller driver to start rotation of the developing roller after the contact/separating unit making contact of the photosensitive drum with the developing roller.

33. A method of removing film from the surface of a photosensitive drum that is in contact with a developing roller, the method comprising:

starting rotation of the photosensitive drum and the developing roller substantially simultaneously;

subsequently stopping rotation of the developing roller to bring the developing roller into a non-rotating condition while maintaining the photosensitive drum in a rotating condition so that surface of the photosensitive drum rubs against the developing roller;

again starting rotation of the developing roller after the step of subsequently stopping rotation of the developing roller; and subsequently simultaneously stopping rotation of the photosensitive drum and the developing roller.

* * * * *